US005718657A

United States Patent [19]

Dalebout et al.

[11] Patent Number: 5,718,657

[45] Date of Patent: Feb. 17, 1998

[54] CABINET TREADMILL WITH REPOSITIONING ASSIST

[75] Inventors: William T. Dalebout; Scott R. Watterson; Frank Troy Miller, all of Logan, Utah

[73] Assignee: ICON Health & Fitness, Inc., Logan, Utah

[21] Appl. No.: 593,801

[22] Filed: Jan. 30, 1996

[51] Int. Cl.[6] ..... A63B 22/02

[52] U.S. Cl. ..... 482/54; 482/112

[58] Field of Search ..... 482/54, 112, 51

[56] References Cited

U.S. PATENT DOCUMENTS

| | | |
|---|---|---|
| D. 207,541 | 5/1967 | Hesen . |
| D. 211,801 | 7/1968 | Quinton . |
| D. 270,555 | 9/1983 | Ogden . |
| D. 283,239 | 4/1986 | Smith et al. . |
| D. 284,597 | 7/1986 | Smith et al. . |
| 321,388 | 6/1885 | Ruebsam . |
| 663,486 | 12/1900 | Boren . |
| 881,521 | 3/1908 | Wilson . |
| 1,020,777 | 3/1912 | Peterson . |
| 1,082,940 | 12/1913 | Flora . |
| 1,715,870 | 6/1929 | Spain . |
| 1,850,530 | 3/1932 | Brown . |
| 1,902,694 | 3/1933 | Edwards . |
| 1,928,089 | 9/1933 | Blickman . |
| 1,973,945 | 9/1934 | Chavin et al. . |
| 2,855,200 | 10/1958 | Blickman . |
| 2,874,971 | 2/1959 | Devery . |
| 3,127,171 | 3/1964 | Noland et al. . |
| 3,378,259 | 4/1968 | Kupchinski . |
| 3,444,830 | 5/1969 | Doetsch . |
| 3,586,322 | 6/1971 | Kverneland . |
| 3,589,715 | 6/1971 | Mark et al. . |
| 3,614,097 | 10/1971 | Blickman . |
| 3,659,845 | 5/1972 | Quinton . |
| 3,731,917 | 5/1973 | Townsend . |
| 3,738,649 | 6/1973 | Miller . |

(List continued on next page.)

FOREIGN PATENT DOCUMENTS

| | | |
|---|---|---|
| 2151551 | 3/1973 | France . |
| 83466 | 8/1908 | Germany . |
| 2 225 342 | 12/1973 | Germany . |
| 24 08 052 | 8/1975 | Germany . |
| 56-56358 | 5/1981 | Japan . |
| 56-150562 | of 1989 | Japan . |
| 1169148 | 10/1969 | United Kingdom . |
| 1 326 263 | 8/1973 | United Kingdom . |
| 1 505 702 | 3/1978 | United Kingdom . |
| 2 120 560 | 12/1983 | United Kingdom . |

OTHER PUBLICATIONS

Copy of brochure entitled "Technology for Total Fitness Genesis 1000", 6 pages—copyright 1985.

Copy of brochure entitled "Technology for Total Fitness Genesis 2000", 6 pages—copyright 1985.

Copy of brochure entitled "Technology for Total Fitness Genesis 3000", 7 pages—copyright 1985.

Cover and selected pages from the Taiwan Buyer's Guide—1993.

Cover page, pp. 2 and 81 of brochure entitled "Taiwan Sports Goods" (Buyers' Guide '95).

*Primary Examiner*—Lynne A. Reichard

*Attorney, Agent, or Firm*—Trask, Britt & Rossa

[57] ABSTRACT

A cabinet has a tread base rotatably connected to be oriented in an exercise position extending outwardly and in a stored position extending inwardly secured within the enclosure of the cabinet. The underside of the tread base may be configured to provide a suitable aesthetic exterior surface. A latching arrangement provided to secure the tread base within the enclosure in the second or stored position. Elevation structure and motor structure are provided to elevate the tread base when in the first position and to power the endless belt of the tread base when in the first position. The elevation structure may be operated to vary the inclination of the tread base when in the first position. The underside of the tread base has a decorative panel and functions as a door for the cabinet. The elevation structure may include an electrically driven rack and pinion as well as a gas cylinder system.

14 Claims, 16 Drawing Sheets

U.S. PATENT DOCUMENTS 3,741,538 6/1973 Lewis et al. .
3,751,033 8/1973 Rosenthal .
3,826,491 7/1974 Elder .
3,858,938 1/1975 Krestensson et al. .
3,874,657 4/1975 Niefojewski .
3,892,404 7/1975 Martucci .
3,963,101 6/1976 Stadelmann et al. .
3,966,182 6/1976 Stadelmann et al. .
4,026,545 5/1977 Schonenberger .
4,066,257 1/1978 Moller .
4,248,476 2/1981 Phelps .
4,300,761 11/1981 Howard .
4,383,714 5/1983 Ishida .
4,422,635 12/1983 Herod et al. .
4,591,147 5/1986 Smith et al. .
4,625,962 12/1986 Street .
4,635,928 1/1987 Ogden et al. .
4,664,646 5/1987 Rorabaugh .
4,679,787 7/1987 Builbault .
4,709,918 12/1987 Grinblat .
4,729,558 3/1988 Kuo .
4,759,540 7/1988 Yu et al. .
4,776,582 10/1988 Ramhorst .
4,805,901 2/1989 Kulick .
4,813,743 3/1989 Mizelle .
4,826,153 5/1989 Schalip .
4,844,449 7/1989 Truslaske .
4,905,330 3/1990 Jacobs .
4,913,396 4/1990 Dalebout et al. .
4,913,423 4/1990 Farran et al. .
4,921,247 5/1990 Sterling .
5,002,271 3/1991 Gonzales .
5,029,801 7/1991 Dalebout et al. .
5,109,778 5/1992 Berkowitz et al. .
5,163,885 11/1992 Wanzer et al. .
5,192,255 3/1993 Dalebout et al. .
5,207,628 5/1993 Graham .
5,352,167 10/1994 Ulicny .
5,441,467 8/1995 Stevens .

CABINET TREADMILL WITH REPOSITIONING ASSIST

BACKGROUND OF THE INVENTION

1. Field of the Invention

This invention relates to exercise treadmills and, more particularly, to exercise treadmills that are positionable within an enclosure for storage in which means are provided to urge the tread base from a first user position to a second position stored within the enclosure.

2. State of the Art

Exercise treadmills typically include a frame having a left side and a right side spaced apart from the left side and in general alignment therewith. A rigid deck is also typically secured between the left side and the right side. A front roller and rear roller are typically connected to and extend between the left side and the right side forward and rearward of the deck. An endless belt is trained around the front roller and the rear roller. The user exercises on the treadmill by walking, jogging or running on the endless belt on top of a deck underlying the endless belt.

Typical treadmills also include surface engaging structure to support the treadmill on a support surface. The surface engaging structure typically includes feet positioned proximate the rear of the treadmill and feet positioned proximate the front of treadmill. The front feet or the rear feet may be operable to vary the inclination of the treadmill with respect to the support surface. For example, U.S. Pat. No. 4,913,396 (Dalebout et al.) discloses a system for varying or adjusting the incline of a treadmill through the use of a pneumatic cylinder. U.S. Pat. No. 4,998,725 (Watterson et al.) discloses an alternate arrangement for varying the inclination of a treadmill.

Treadmills also include handles or other upright structure such as that shown in U.S. Pat. No. Des. 304,849 (Watterson), U.S. Pat. No. Des. 306,468 (Watterson), U.S. Pat. No. Des. 306,891 (Watterson), U.S. Pat. No. Des. 316,124 (Dalebout et al.), U.S. Pat. No. Des. 318,699 (Jacobson et al.), U.S. Pat. No. Des. 323,198 (Dalebout et al.), and U.S. Pat. No. Des. 323,199 (Dalebout et al.). Reorientation or repositioning of the upright structure to facilitate storage has also been disclosed. U.S. Pat. No. 5,102,380 (Jacobson et al.) shows a treadmill in which a center post may be reoriented from an upright operating position to a lowered position in alignment with the treadmill and with the belt or deck. U.S. Pat. No. Des. 211,801 (Quinton) shows a treadmill with structure that may be moved from an upright position to a lowered position in general alignment with the treadmill belt or deck. U.S. Pat. No. Des. 207,541 shows a treadmill that may be reoriented from a horizontal operating condition to an upright storage position.

Storing exercise equipment inside a cabinet or other enclosure is also known. U.S. Pat. No. 4,300,761 (Howard) shows an exercise bench which may be repositioned interior a cabinet for purposes of storage. U.S. Pat. No. 3,741,538 (Lewis et al.) shows an arrangement in which the exercising structure is folded upright for storage against a wall surface. U.S. Pat. No. 3,642,279 (Cutter) shows a treadmill in which an upright structure may be reoriented to be generally in alignment with the endless belt for purposes of reorienting the treadmill to an upright or storage configuration.

U.S. Pat. No. 4,679,787 (Guilbault) shows a bed combined with a treadmill or rolling structure in which the bed is positioned over the top of the treadmill or rolling structure for purposes of storage. U.S. Pat. No. 4,757,987 (Allemand) shows a treadmill which may be reconfigured into a compact, foldable structure which may, in turn, be transported. U.S. Pat. No. 4,066,257 (Moller) shows a treadmill positioned within a cabinet that is secured to a wall and reoriented between an upright stored position and an extended or horizontal position for use.

SUMMARY

An exercise treadmill has a freestanding housing. The freestanding housing has surface engaging means for engaging the support surface. The freestanding housing also has an enclosure structure extending upwardly from the surface engaging means. The treadmill also has a tread base with a left side and a right side. An endless belt is positioned thereinbetween. The tread base is movably attached to the freestanding housing to be orientable between the first position in which the tread base extends away from the housing with the endless belt positioned to support a user performing exercises thereon and a second position in which the tread base is positioned toward the freestanding housing. Desirably the tread base is positioned to be substantially within the freestanding housing. The treadmill also has lift means interconnected between the enclosure structure and the tread base to urge the tread base from the first position toward the second position.

In a preferred arrangement, the lift means is a gas cylinder which continuously urges the tread base from the first position to the second position. Desirably, the gas cylinder is attached to one of the left side or the right side at one end of the gas cylinder. The enclosure structure has a left wall and a right wall. The other end of the gas cylinder is attached to the respective left wall or right wall.

Preferably the tread base rotates about an axis between the first position and the second position. The gas cylinder is attached to one of the left side and right side between the axis and the rear end of the tread base. The gas cylinder desirably exerts a force selected to be less than the downward gravitational force of the tread base when the tread base is moving between the first position and the second position. That is, as the tread base rotates out of the second position towards the first position, gravitation will cause the tread base to rotate. The gas cylinder exerts a force inhibiting that rotation by exerting a force to rotate the tread base from the second position toward the first position. Thus, it may be said that as the user is lowering the tread base, the user is holding less than the full weight of the tread base. Similarly, to lift the tread base from the first position toward the second position, the user need exert a lifting force less than what would be needed to rotate the tread base up and toward the second position.

In the second position, the tread base is desirably substantially within the enclosure structure. The enclosure structure preferably has a left side and a right side with the tread base being positioned substantially between the left side and the right side. The enclosure structure also preferably has a back and side and a top.

BRIEF DESCRIPTION OF THE DRAWINGS

In the drawings which illustrate what is presently regarded as preferred embodiments.

DETAILED DESCRIPTION OF THE ILLUSTRATED EMBODIMENT

Figure 1:
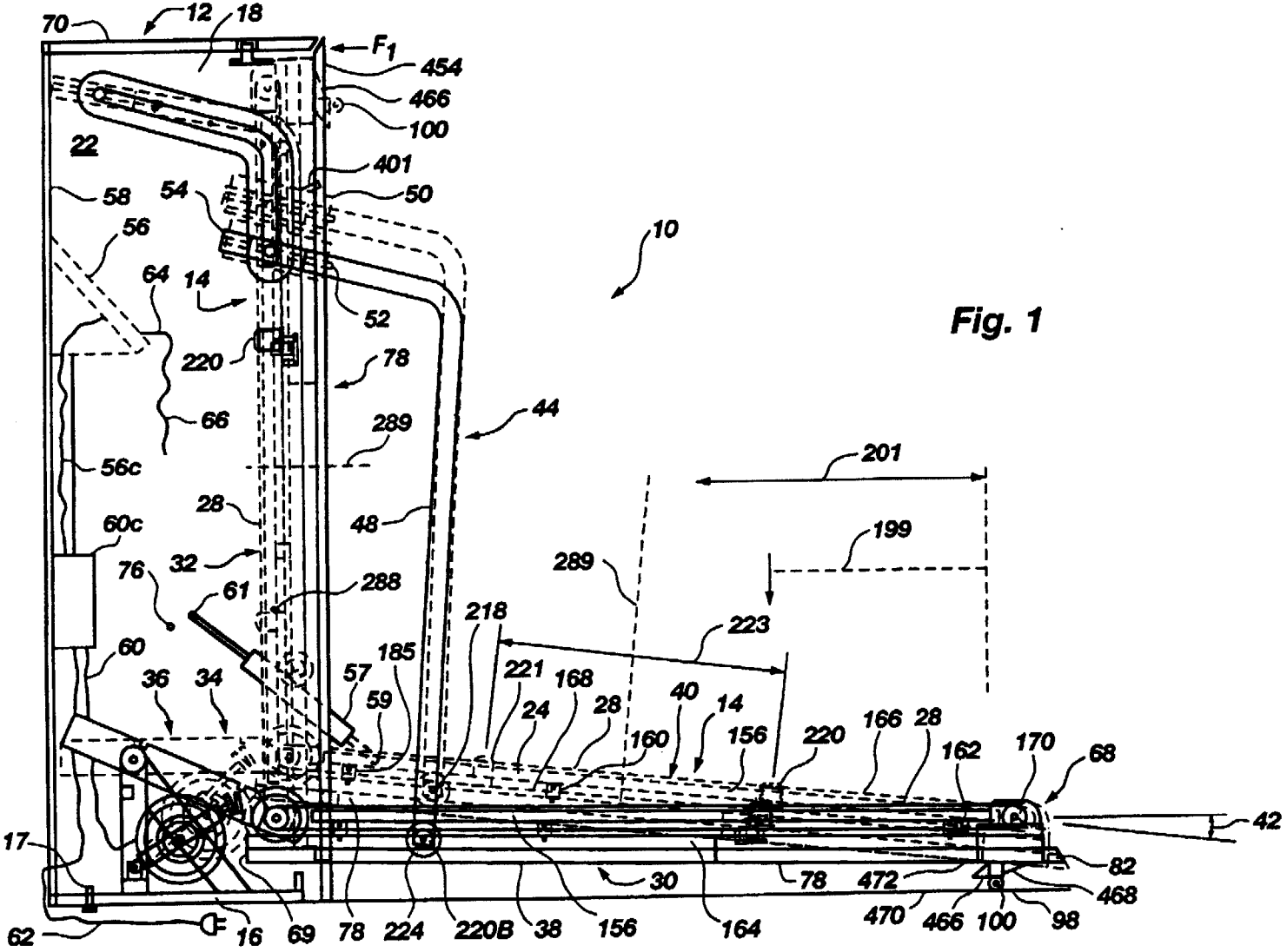
FIG. 1 is a cross-sectional side view of a cabinet treadmill of the instant invention with a tread base positionable between a first incline position and a second incline position, as well as orientable between a first position and a second stored position.

FIG. 1 shows a cabinet treadmill 10 having a freestanding housing 12, as well as a tread base 14. The freestanding housing 12 has surface engaging means to support the freestanding housing 12 on a support surface. The surface engaging means of FIG. 1 is shown to be a base 16 which is formed to be generally planar for positioning on a generally planar support surface. Inventors skilled in the art will recognize that other surface-engaging structures may be used, including one or more feet 17 threadedly engaged with the base 16 to be adjustable in height. In one arrangement, feet may be positioned proximate the four corners of the freestanding housing 12. The feet 17 may be used to level the base 16 on the support surface. The base 16 or any other surface-engaging structure, such as the feet 17, functions to support the freestanding housing 12 to be, in fact, freestanding when positioned on a support surface.

The freestanding housing 12 has enclosure structure 18 which extends upwardly from the surface-engaging means. The enclosure structure 18 may be formed in any desirable shape with an open side sized to receive the tread base. In the illustrated arrangement, the enclosure structure 18 is shaped to be rectilinear in projection. Other shapes or configurations may be used as desired. The enclosure structure 18 has a left side 20 and a right side 22 which as here shown is spaced from and in general alignment with the left side 20.

Figure 2:
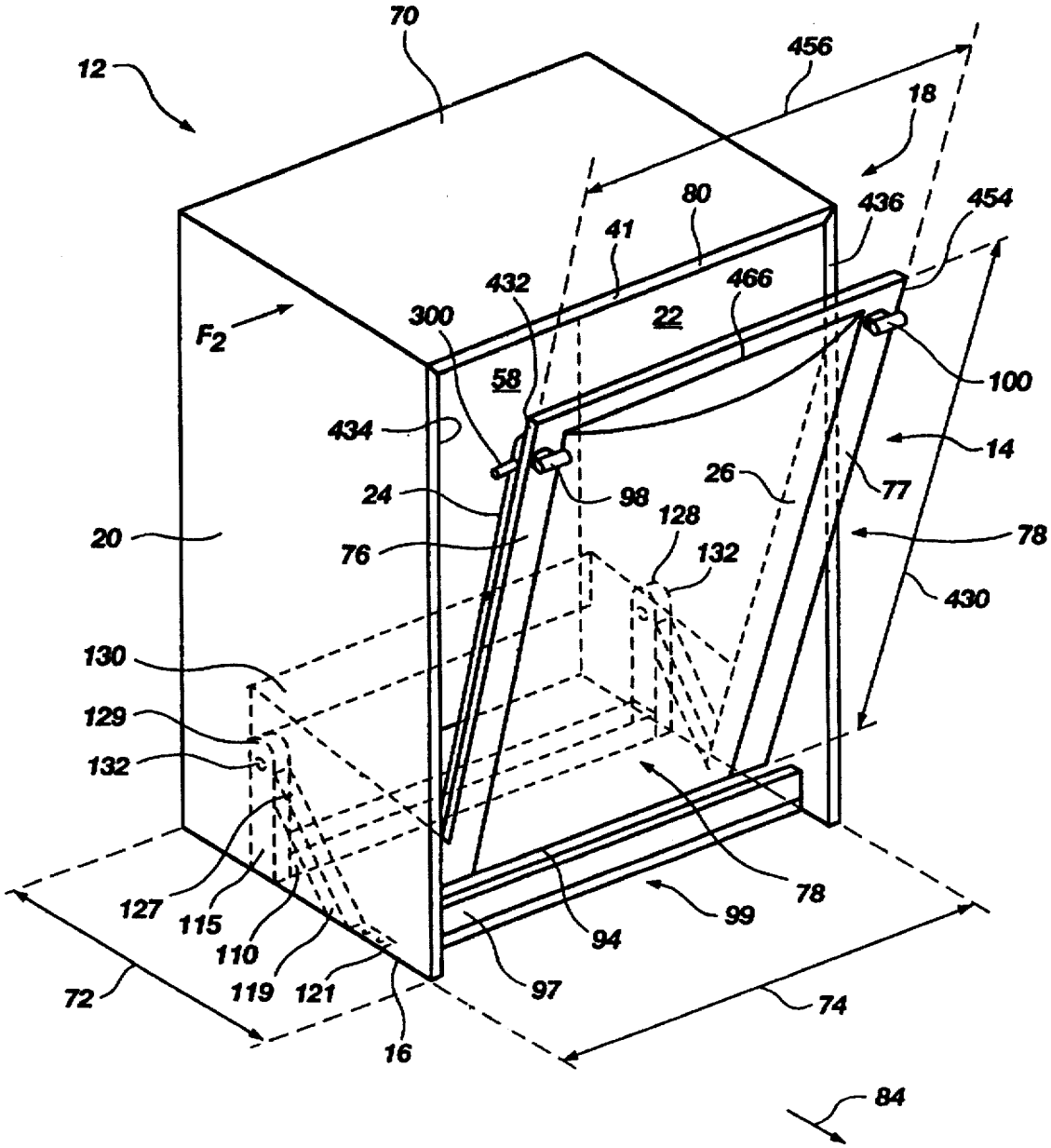
FIG. 2 is a simplified, perspective view of a treadmill with the tread base in the second stored position.

The tread base 14 also has a left side 24 and a right side 26 (FIG. 2). An endless belt 28 is positioned between the left side 24 and the right side 26. The tread base 14 is configured for the performance of treadmill exercises such as walking, jogging or running.

The tread base 14 is orientable between a first position 30 in which the tread base 14 extends away from the freestanding housing 12 with the endless belt 28 positioned to support a user performing exercises thereon and a second or stored position 32 in which the tread base 14 is positioned upwardly toward the freestanding housing 12. More specifically, the tread base 14 is reorientable between the first position 30 and the second position 32 in which the tread base 14 is moved toward and positioned substantially within the enclosure structure 18.

As also seen in FIG. 1, the treadmill 10 includes elevation structure 34 positioned forwardly of the tread base 14. The elevation structure 34 is operable to orient the tread base 14 between a first orientation 38 and a second orientation 40. That is, the tread base 14 is rotatable from the first orientation 38 to the second 40 through angle 42. The treadmill also has a motor 36 that is connected to drive the endless belt 28.

As best seen in FIG. 2, the cover 78 functions as a cabinet door when the tread base 14 is in the second or storage position 32. The cover 78 is here shown with a left rail 76 and a right rail 77. The left rail 76 is shown in more detail in FIG. 15. The left rail 76 and right rail 77 are each formed to extend along the length 430 of the cover 78 and are each similarly formed out of a suitable material such as plastic.

Figure 15:
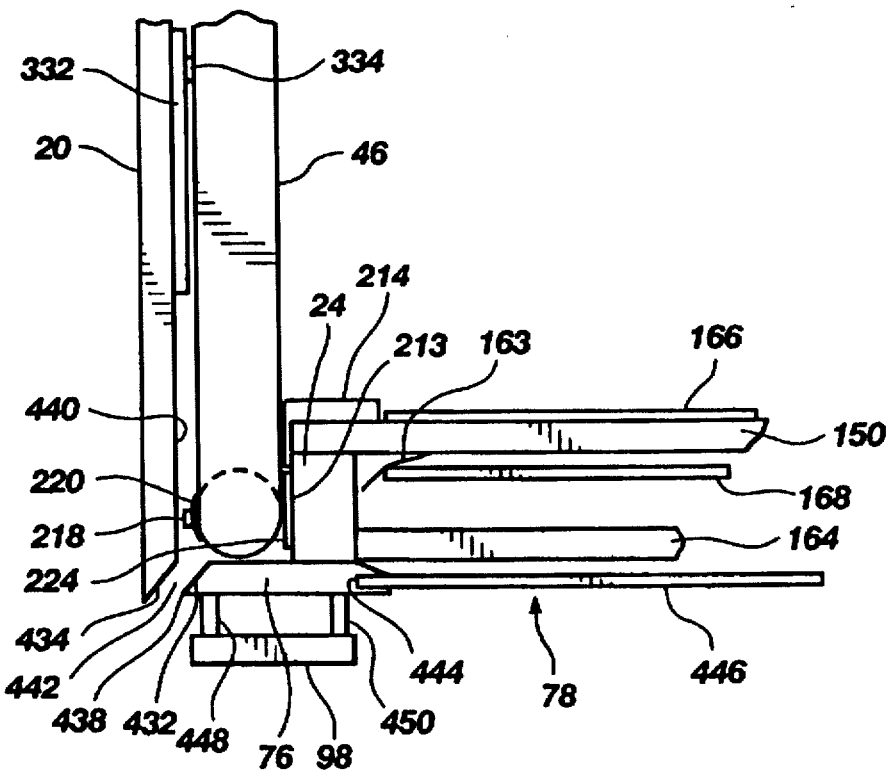
FIG. 15 is a simplified, top cross-sectional view of a portion of the treadmill of FIG. 2.

As shown in FIG. 15, the left rail 76 has an angled edge surface 432 formed to mate with a corresponding edge surface 434 of the left side 20. Similarly, the right rail 77 has an angled edge surface to face a corresponding angled edge surface 436 of the right side 22. As can be seen, the outer tip 438 of the edge surface 432 is positioned to clear the inner surface 440 of the left side 20 when the tread base 14 is rotated from the stored position 32 toward the first position 30. Thus a small gap 442 exists between and is defined by the opposing angled surfaces 434 and 432.

The left rail 76 also has a notch 444 formed along its interior side. The slot or notch 444 is sized to snugly and slidably receive a decorative panel 446. The decorative panel 446 may be made of any acceptable material such as plastic, formica or plywood. The panel 446 may have raised portions or indentations formed in various designs and patterns. Other materials may be adhered to the panel 446 including paint, wallpaper or even decorative moldings. The left rail 76 is shown attached to the left side 24 by any acceptable means including screws, bolts and even adhesives (e.g. thermoplastic glues). The left foot 98 is also shown attached to the left rail 76 by bolts or screws (not shown) through spacers 448 and 450. The left foot 98, as well as the right foot 100, function as feet to support the tread base 14 in the first position, and they function as handles for grasping by the user to move the tread base between positions.

Figure 16:
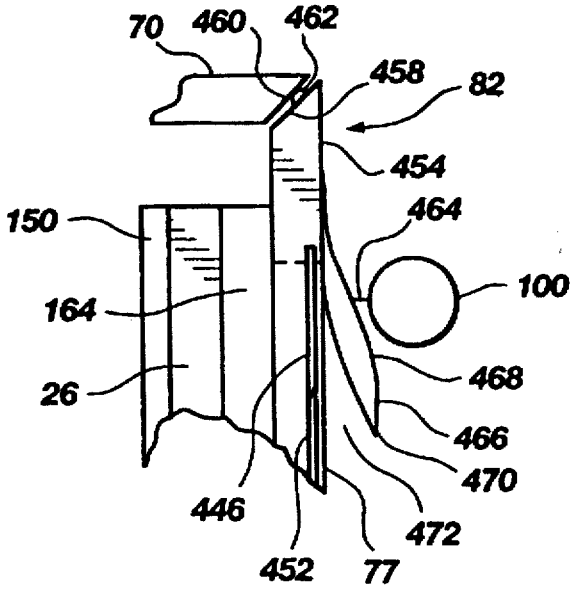
FIG. 16 is a simplified, side cross-sectional view of a portion of the cover of the treadmill of FIG. 2.

In FIG. 16, the right rail 77 is shown with the panel 446 in the corresponding slot or notch 452. An upper cross member 454 is shown mounted to extend the width 456 of the door. The upper cross member 454 has an angled surface 458 that mates or abuts a corresponding angled surface 460 of the top 70 of the enclosure structure 18. One or more rubber-like bumpers may be attached either to surface 460 or surface 458 to act as a cushion and spacer between the surfaces 460 and 458. The right foot 100 is also shown attached to the right rail 77 by a pair of spacers such as spacer 464.

FIG. 16 also shows a handle 466 which is sized to extend between the left rail 76 and the right rail 77. It may be attached either to the upper cross member 454 as shown or to the left rail 76 and right rail 77. The handle 466 is shaped with an arcuate exterior surface 468 and an arcuate lower edge 470 to define a recess 472 between the panel 446 and the exterior surface 468. The recess 472 is sized at its midpoint to accept the fingers of a user. Therefore with the tread base 14 in its first position, the user may reach under the tread base 14 and engage the lip 82 created by the cross member 454. As the user begins to lift the lip 82 upward, the user may engage the handle 466 with the fingers in the recess 472 or as otherwise convenient. The user may also use handles 98 and 100 once the rear 68 of the tread base 14 is elevated above the support surface.

FIG. 1 also shows the cabinet treadmill 10 with handle structure 44 which here consists of a left handle 46 (FIG. 6) and comparable right handle structure 48. The handle structure 44 is rotatably connected to the tread base 14 and is also movably connected to the freestanding housing 12. The handles 46 and 48 are rarely mounted with the treadmill 10 in the first orientation or position and movable to a stored configuration when the tread base 14 is oriented into the second or storage position 32.

FIG. 1 also shows a cabinet treadmill 10 with a control arrangement such as control console 50. The control console 50 is interconnected between the left handle 46 and the right handle 48 through slots 52 formed in the upper end 54 of each of the left handle 46 and right handle 48. That is, a user console 50 may be secured to and between the handles 46 and 48 by another bolt arrangement positioned through or in the slots 52 formed near the end 54 of each of the handles 46 and 48. Electrical conductors can extend through one or both of the handles 46 and 48 and through the left side 24 or right side 26 for operative connection to the motor 36. The conductors are not shown to simplify the drawings.

Alternately, a control console 56 may be positioned along the back wall 58 of the enclosure structure 18. The console 56 may be interconnected by conductors 56C to a motor controller 60C which is, in turn, connected by conductors 60 to the motor means 36 and to receive electrical power via plug 62. Other control console arrangements may be used to present the user with data and controls.

The console 56 may also have a safety switch which includes a card 64 with a lanyard 66 sized for attachment to a user. As known to those in the art, in operation, the user inserts the card 64 as a key and attaches the lanyard 66 to his or her person. In the course of operation, should the user move towards the rear 68 of the tread base 14, the lanyard 66 removes the card 64 to, in turn, turn off the electric motor.

FIG. 1 also shows a gas cylinder 57 optionally in place to provide a force to assist the user in lifting the tread base 14 from the first position 30 toward the second or storage position 32 and in returning the tread base 14 from the storage position 32 to the first position 30. The gas cylinder 57 is a conventional gas cylinder rotatably attached at one end 59 to the tread base 14 and to the enclosure structure 18 at its other end 61. More specifically the gas cylinder 57 is rotatably attached to the left side 24 and to the left side or wall 20 of the enclosure structure 18. The gas cylinder 57 may also be attached at other locations to provide a force or torque to continuously urge the tread base 14 upward toward the storage position 32. Thus the force to be exerted by a user to rotate the tread base 14 between the first position and the storage position is reduced and set by selecting an appropriately sized gas cylinder.

Referring to FIGS. 1 and 2, it can be seen that the left side 20 and a right side 22 are in general alignment and attached to the base 16. The enclosure structure 18 also has a top 70 and a back 58 which together form a cabinet into which the tread base 14 is positioned for storage. That is, the tread base 14 is rotated into the second or storage position 32 to be substantially within the enclosure structure 18 as shown in FIG. 1 and as shown in transition in FIG. 2.

The base 16 has a depth 72 and a width 74 which are selected to provide the enclosure structure 18 with a footprint to stably support the enclosure structure 18 and, in turn, the treadmill on a support surface. More specifically, the depth 72 (FIG. 2) is selected relative to the center of gravity 76 (FIG. 1) of the enclosure structure 18 with the tread base 14 in the second or storage position 32. That is, the depth 72 is selected to not only accommodate all of the structure of the various components as shown in FIG. 1, but also so that a force $F_1$ applied at or near the top 70 of the enclosure structure 18 will need to be deliberately and specifically applied in order to cause the enclosure structure 18 to tip or rotate on the support surface. Similarly, the width 74 is selected so that any force $F_2$ applied to the enclosure structure 18 at the top 70 will need to be significant in order to cause the enclosure structure 18 with the tread base in the stored position to rotate relative to the support surface. Forces $F_1$ and $F_2$ in excess of ten (10) pounds and estimated to be in the range of 15 to 30 pounds are contemplated.

Although the depth 72 and the width 74 of the enclosure structure 19 may vary for different treadmills having tread bases of different dimensions, for a typical treadmill having an endless belt 28 with an overall length of about 40 inches or more, a depth 72 from about 18 inches to about 30 inches and a width 74 from about 24 inches to about 36 inches may be found suitable.

As hereinbefore noted, the enclosure structure 18 has fully enclosed sides 20 and 22, as well as a fully-enclosed back 58 and top 70. In effect, the enclosure structure 18 constitutes a cabinet into which a tread base 14 is positioned for storage. The cabinet may be fabricated or modified to present a variety of different external appearances in order to be compatible with other furniture items such as bookcases or the like. Indeed, hooks, fasteners or the like may be associated with the sides 20 and 22 in order to integrate or connect the cabinet within a collection of wall furniture which would include, by way of example, bookcases, stereo cabinets and the like.

It may be noted that as the tread base 14 is rotated from the first position 30 to its second or stored position 32, the bottom or underside of the tread base 14 will be exposed. The bottom may contain sharp edges, exposed components or parts and, in general, would be unfinished. Therefore, a cover 78 is attached to extend between the sides 24 and 26 and between the rear 68 and the front 69. The cover 78 may be fabricated of any convenient substance to be consistent with, complementary to or the same as the substance used to form the exterior surfaces or sides 20, 22 and back 58 of the enclosure structure 18.

Figure 3:
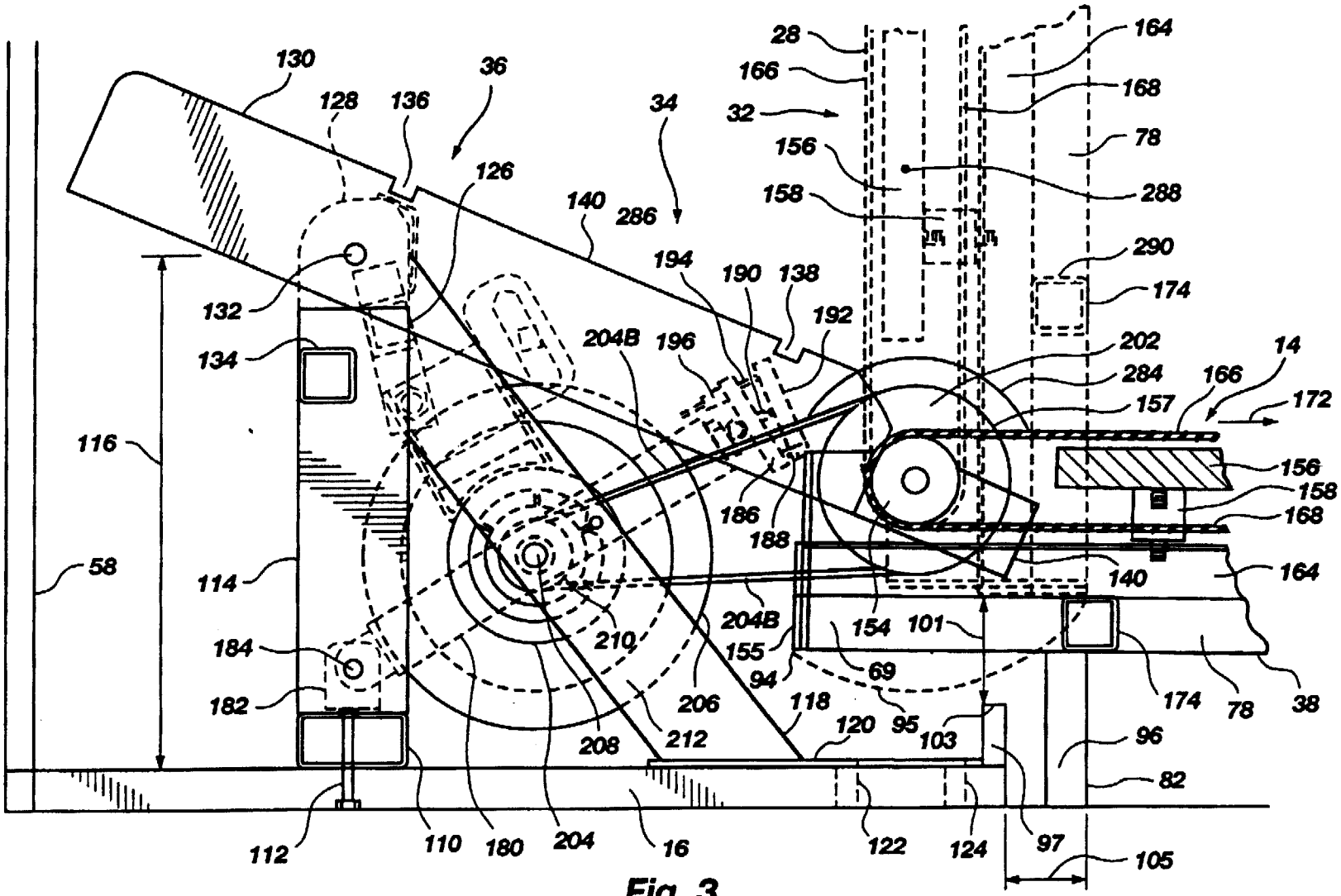
FIG. 3 is a partial side cross-sectional view showing the motor and elevation structure of the treadmill of FIG. 1 with the tread base in a first incline position and in a second stored position.
Figure 10:
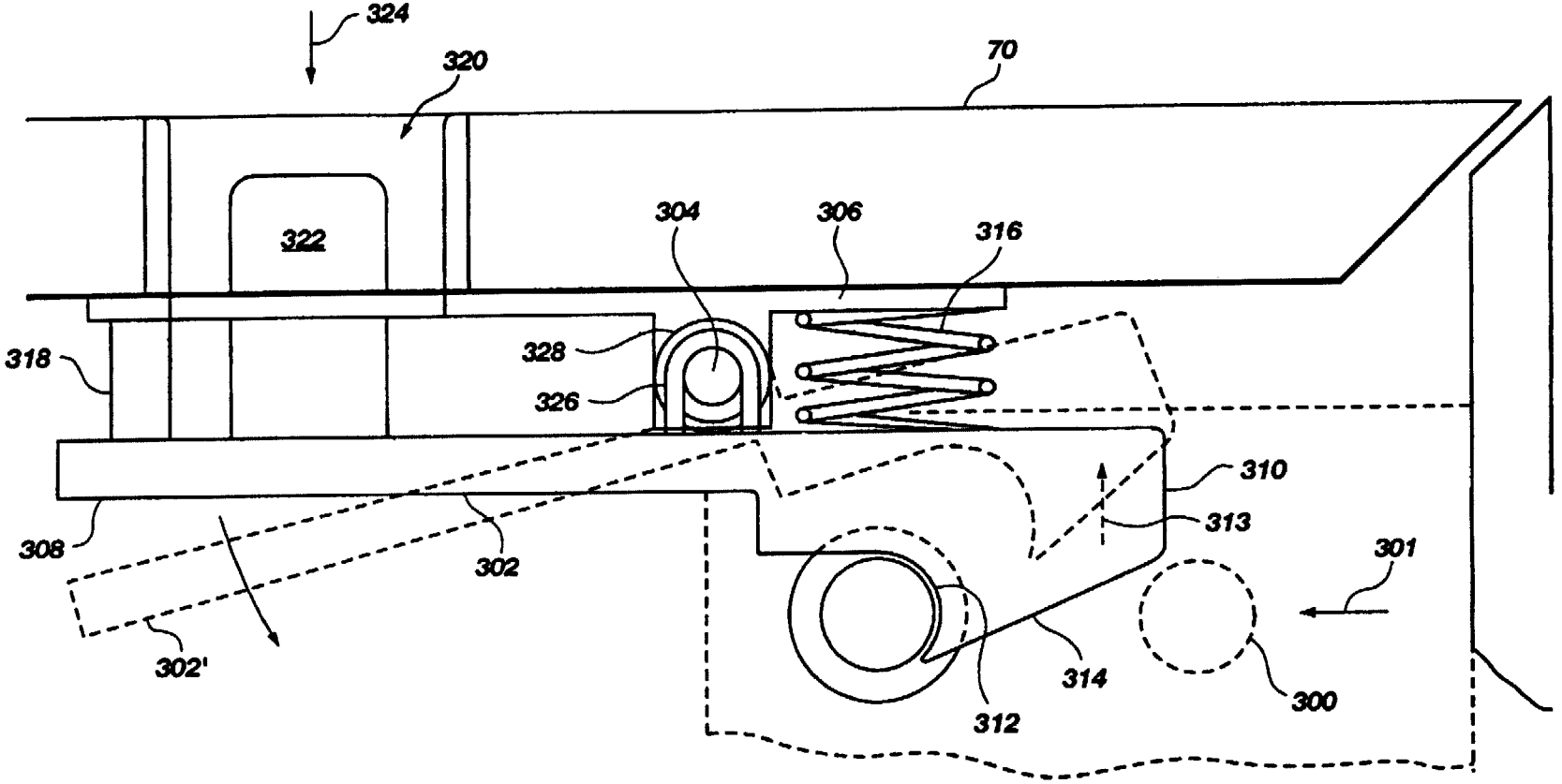
FIG. 10 is an enlarged, simplified side view of latching structure in the upper portion of the cabinet treadmill of FIG. 1.

At the front end 69 of the tread base 14, the cover 78 forms a front edge 94 which moves through an arc 95 and over a toe kick 97 from the first position 30 to the second position 32 (FIG. 3). That is, the edge 94 is spaced a distance 101 above the top 103 of the toe kick 97 creating a gap. However, the toe kick 97 is spaced inwardly a distance 105 so that the gap is not easily visible. Further, the toe kick and the front edge define a space 99 comparable to that found for many kitchen counter cabinet structures to receive the toes of a user closely approaching the cover 78 so as to, for example, operate the button 322 (FIG. 10).

Figure 4:
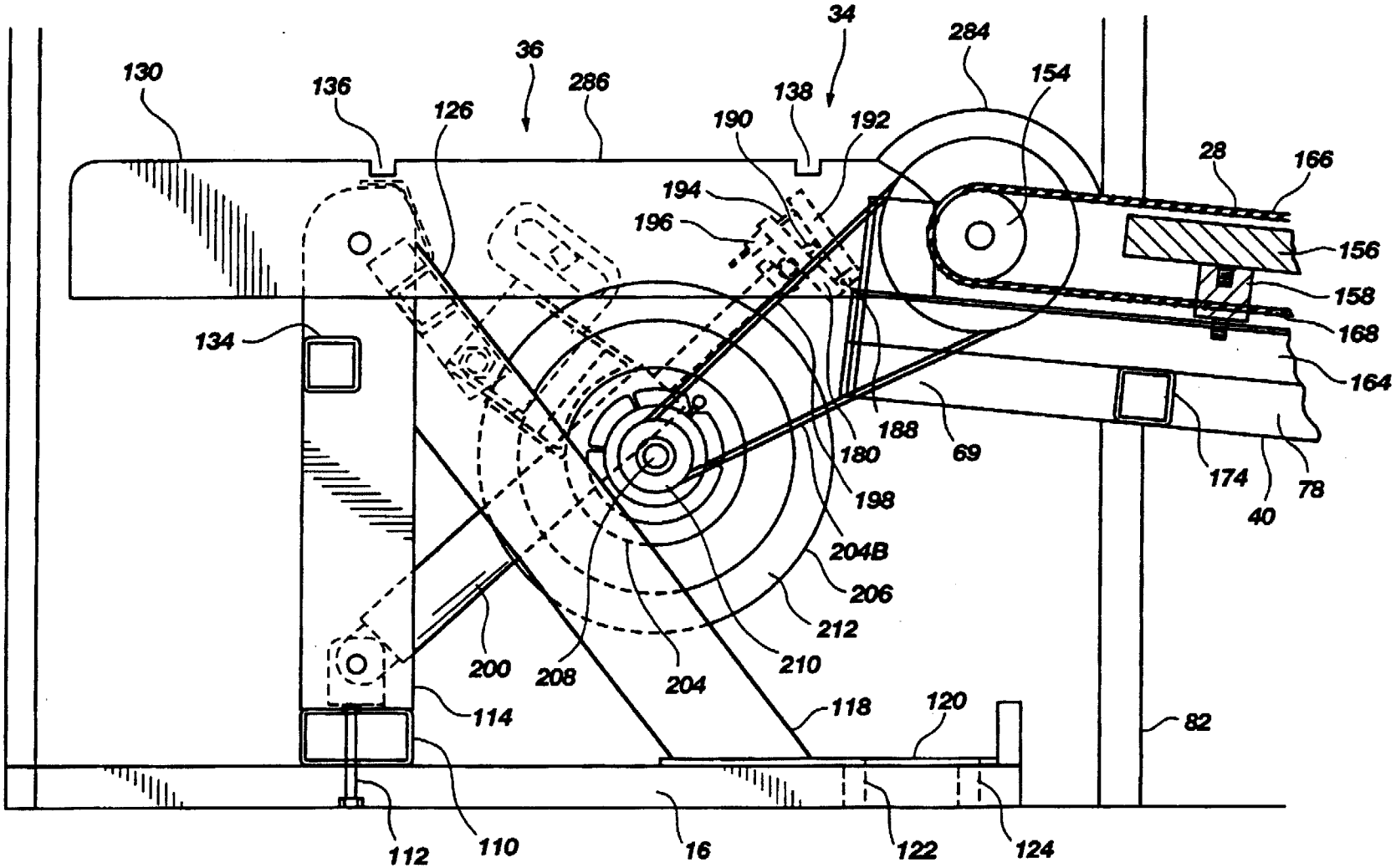
FIG. 4 is a partial cross-sectional view of portions of the treadmill of FIG. 1 in a second incline position.

Turning now to FIGS. 3 and 4, the forward end 69 of the tread base 14 as well as the lower portion of the enclosure structure 18 is shown with the associated motor means 36 and elevation structure 34. More particularly, the base 16 is shown with a stiffener 110 which extends between the left side 20 and the right side 22 of the enclosure structure 18. The stiffener 110 is shown held to the base 16 by a plurality of bolts 112 or any acceptable or comparable fastening arrangement. A right upright 114 and a left upright 115 (FIG. 2) are hollow channels which extend uprightly from the base 16 and above the stiffener 110.

The right upright 114 and left upright 115 both extend a height 116 selected to position the motor means 36 and its related components above the base 16. The right upright 114 and left upright 115 are reinforced by diagonals 118 and 119 which are welded or otherwise fastened to mounting plates 120 and 121 that are held to the base 16 by a plurality of bolts such as bolt 122 and bolt 124. The diagonals 118 and 119 are connected at the upper ends 126 and 127 to the uprights 114 and 115, respectively. Notably the stiffener 110, the uprights 114 and 115 and the diagonals 118 and 119 are all formed from a hollow rectilinear channel.

At the upper or distal end 128 of the right upright 114 and at the upper or distal end 129 of upright 115, a base extension 130 is rotatably connected to rotate around an axle 132. As can be seen in FIGS. 3 and 4, the base extension 130 is rotatable about axle 132 between a first position shown in FIG. 3 and a second position shown in FIG. 4. That is, the base extension 130 is mounted to and between the right upright 114 on the left side and the left upright 115 (FIG. 2). The left upright 115 is comparable in height 116, form and function as that of upright 114. It may be seen that the uprights 114 and 115 also have a stabilizing cross bar 134 attached to extend between the uprights 114 and 115 to strengthen and support the uprights 114 and 115.

The base extension 130 has a forward groove 136 and a rear groove 138 formed in the top surface 140 to receive screws (not shown) to connect the base extension 130 through other bracket structure to rotate about the axle 132. As better seen in FIG. 6, the base extension 130 has a left finger 140 and a right finger 142 that extend outwardly for rotatable connection by bolts 144 and 146 to the left side 24 and the right side 26 of the tread base 14. As better seen in FIG. 6, the fingers 140 and 142 rotatably attach within notches or recesses 148 and 150 formed in sides 24 and 26 so that the exterior surface 152 of the right side 26 and the exterior surface 155 of the left side 24 may be said to be essentially flat or planar.

It may also be noted that the tread base 14 has a front roller 154 with the endless belt 28 trained thereabout. More specifically, the tread base 14 has a tread deck 156 mounted by a plurality of rubber-like mounts 158, 160 and 162 (FIG. 1) to provide a cushioning effect when the user is walking, jogging or running on the endless belt 28 on the tread deck 156.

It may be noted that the mounts 158, 160 and 162 are mounted to a mounting base 164. The mounts 158, 160 and 162 are spaced to the right side of the tread base 14 and the endless belt 28. A comparable plurality of mounts (not shown) are also positioned to the left of the endless belt 28. It may also be noted that the endless belt 28 has an upper stretch 166 and a lower stretch 168. In normal operation, the upper stretch 166 moves from the front roller 154 toward 172 the rear roller 170. The lower stretch 168 moves from the rear roller 170 toward the front roller 154 in between the left and right rubber mounts such as rubber mounts 158, 160 and 162 and in contact with one or more belt guides 163 (FIG. 15). It may also be noted that the cover 78 contains a supporting cross channel member 174 positioned forwardly with respect to the tread base 14.

As noted hereinbefore, the tread base 14 may be rotated from the first position in which it is oriented as shown in FIG. 1 for use by a person performing exercises on the endless belt 28 to a second position in which the tread base 14 is rotated upwardly toward and more specifically within the enclosure structure 18. Thus, the endless belt 28 including the upper stretch 166, the lower stretch 168, as well as the tread deck 156, the mounting base 164 and the cover 78, are all oriented upward and as shown in FIGS. 1, 3 and 4 to be generally upright to act as a closed door of a cabinet.

Referring back to FIGS. 3 and 4, it can also be seen that the tread base 14 is operable between a first orientation 38 shown in FIG. 3 and a second orientation 40 shown in FIG. 4. That is, the inclination or elevation of the tread base 14 relative to a support surface may be varied through angle 42 upon operation of inclination structure. The inclination structure illustrated in FIGS. 3 and 4 consists of a pneumatic cylinder 180 connected at one end to a bracket 182 by a pin 184. Bracket 182 is secured to the stiffener 110 by conventional means including screws, welding and the like. The pneumatic cylinder 180 is secured at its other end by another bracket 186 which is secured to the underside of the base extension 130 by any acceptable fastening means including pins or the like including, for example, pin 188.

The pneumatic cylinder 180 has a valve 190 which is operable by lever 192. The lever 192 is moved relative to the bracket 186 by operation of a cable 194 positioned within a sheath 196 fastened to the bracket 186. Thus, as the cable 194 is moved, the lever 192 moves toward the bracket 186 to operate the valve 190 to in turn cause the pneumatic cylinder to operate to in turn urge the base extension 130 to rotate upward about axle 132. That is, operation of the valve 190 operates the pneumatic cylinder 180 in such a fashion that the internal piston shaft 198 extends to urge the deck extension 130 to its upward orientation shown in FIG. 4.

Figure 6:
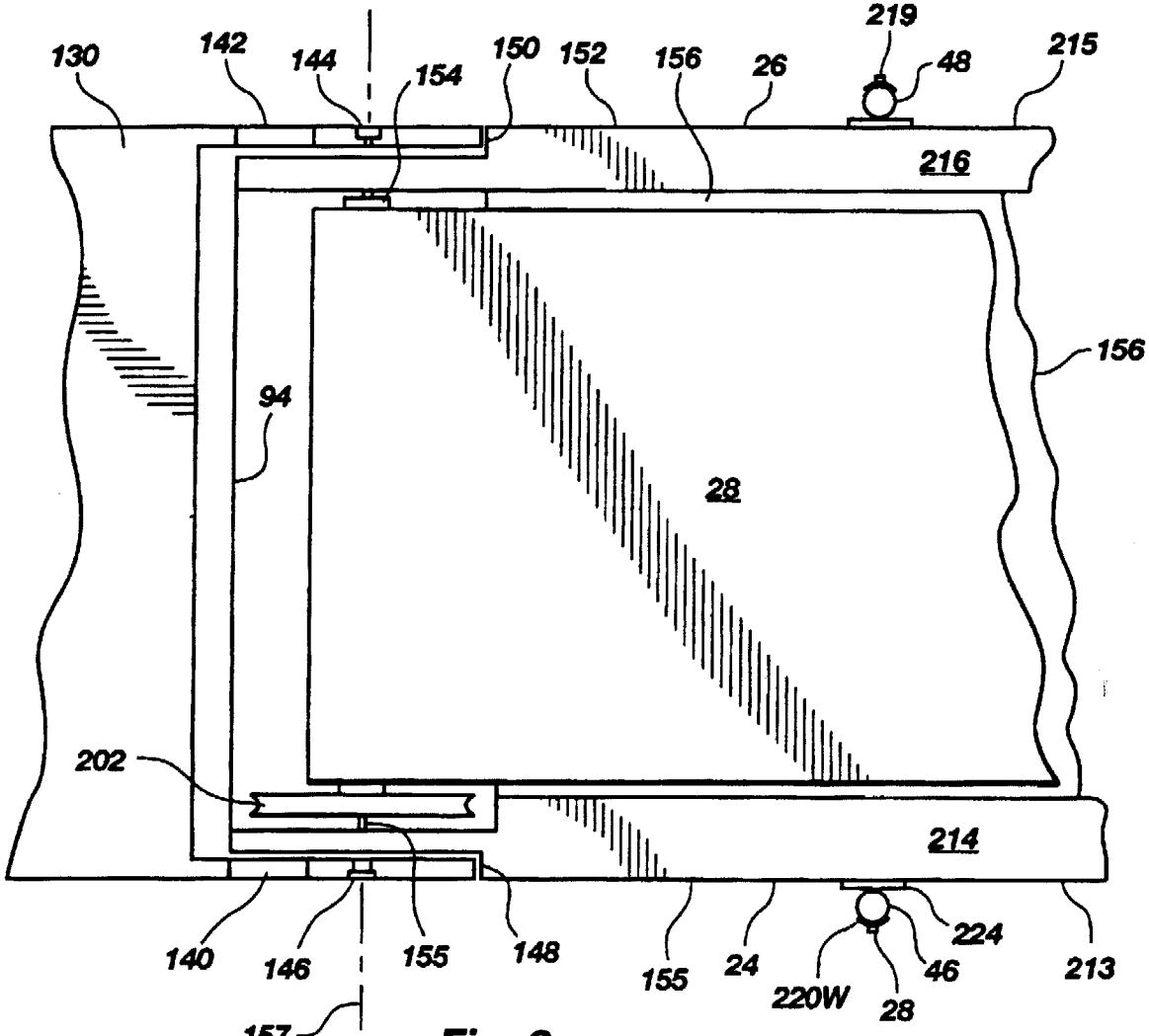
FIG. 6 is a partial top view of portions of the cabinet treadmill of FIG. 1.

Since the deck extension 130 is rotatably attached to the front end 69 of the tread base 14, as better seen in FIG. 6, it can be seen that the tread base 14 is thereby urged from the first orientation 38 to the second orientation 40. To cause the orientation to move from the second orientation 40 to the first orientation 38, the user may move his or her weight forward or rearward 172 on the upper stretch 166 of the endless belt 28 to in turn vary the moment arm 199 or torque being exerted about the rear feet 98 and 100 which function as a fulcrum for varying the moment arm associated with the user's weight as the user moves forward or rearward 172 on the endless belt 28. As the user varies the distance 201, the moment arm 199 may exceed the upward force applied by the pneumatic cylinder 180 and in turn overcome the force and urge the internal piston shaft 198 inward into the cylinder housing 200 to vary the orientation between the first orientation 38 and the second orientation 40 and any desired orientation thereinbetween.

Figure 7:
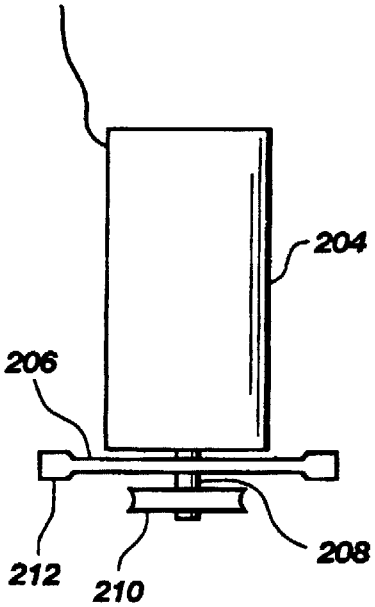
FIG. 7 is a partial side view of a motor for use with a treadmill of FIG. 1.

As better seen in FIG. 6, the front roller 154 on the left side has a pulley 202 secured thereto. The pulley 202 is configured to receive a drive belt 204 in a driving relationship with motor means. The preferred motor means in FIG. 7 is an electric motor 204 with a flywheel 206 mounted to its drive shaft 208. A drive pulley 210 is also mounted to the drive shaft 208 to drive the pulley 202 via belt 204B. It may be noted that the flywheel 206 is configured to have an increased mass 212 proximate its outer rim to enhance the inertial characteristics thereof.

It may be noted that the inertia wheel or flywheel 206 is here driven by and functions with the electric motor 204. In some configurations, the flywheel 206 may be the only motor means involved inasmuch as it operates to deliver energy to drive the endless belt 28 when the user is walking, running or jogging. Of course, the flywheel 206 would receive energy as the user urges the endless belt 28 in the course of walking, jogging or running. Thus, the flywheel 206 without motor 204 receives its energy from the user and delivers that energy to the belt 28 when the user is not delivering energy to the belt when, for example, the user is jogging and in turn not always in contact with the endless belt 28. Alternatively, in a separate arrangement, an electric motor 204 may be provided to drive the pulley 210 and in turn the belt 204B with or without the flywheel 206. The arrangement shown in FIG. 7 includes a motor with a flywheel to provide stable rotational energy via the belt 204 to the driven pulley 202.

It may also be noted from examination of FIG. 6 that the left handle 46 is seen attached to the outside 213 of the left side rail 214. The right handle 48 is attached to the outside 215 of the right side rail 216. As better seen in FIG. 1, the handles 46 and 48 are rotationally attached to the respective left side rail 214 and right side rail 216 by appropriate structure which includes for example bolt 218 which holds the handle 46 between an appropriate washer 220W and an appropriate wear bushing 224. The handles 46 and 48 rotate about their respective bolts 218 and 219 as the tread base 14 is rotated from its first position 30 to its second or stored position 32.

Figure 9:
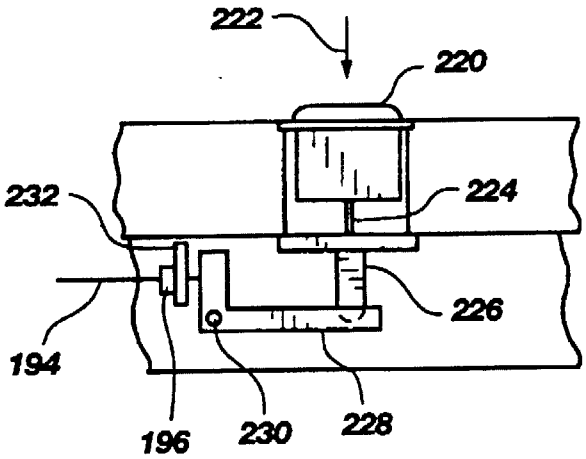
FIG. 9 is a side view of a portion of the tread base of the treadmill of FIG. 1 with an elevation button.
Figure 5:
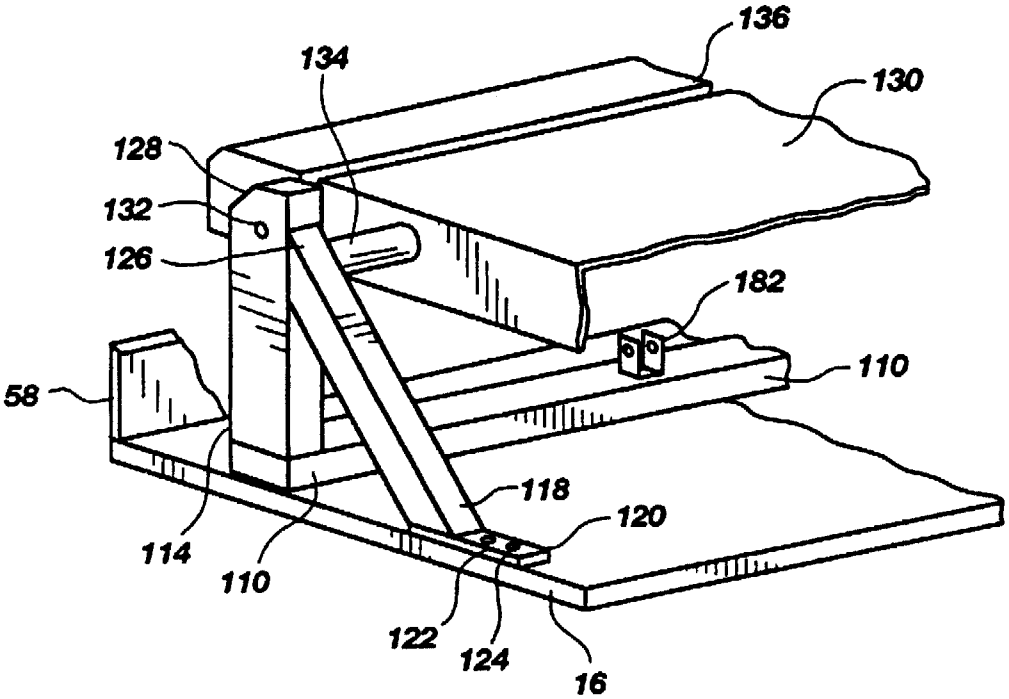
FIG. 5 is a simplified, partial perspective view of selected elements of the structure of FIGS. 3 and 4.

As hereinbefore stated, the pneumatic cylinder 180 has a valve 190 which is operated by movement of the lever 192 relative to the bracket 186. The movement is effected by operating the cable 194 which is positioned within the sheath 196 in a manner similar to that shown and described in U.S. Pat. No. 5,372,559, the disclosure of which is incorporated herein by reference. As better seen in FIG. 9, the cable 194 is operated by operation of a foot button 220 positioned in the left side 24 or the right side 26 as desired.

Upon urging the button 220 downward 222, the corresponding stem 224 urges an extension 226 downward. The extension 226 is connected to the lever 228 which rotates around axis 230. Upon rotation, the lever 228 pulls the cable 194 relative to the sheath 196. That is, the sheath 196 is fixedly secured to a bracket 232 so that the cable 194 moves relative to the sheath 196 to, in turn, cause the valve 190 to operate upon downward 222 movement of the button 220. Upon release of the button 220, internal pressures urge the valve 190 to its extended position as shown in FIGS. 3 and 4. In turn, the cable 194 is urged relative to the bracket 232 to urge the button 220 back to its original or upright position generally shown in FIG. 9.

FIG. 1 shows a rear button 220 as well as a forward button 221. The forward button 221 is structured the same as button 220 and is connected via a separate cable to the lever 192 for operating the lever 192 and in turn the valve 190 the same as button 220. Thus a user to raise the elevation of the tread base 14 may stand rearwardly on the tread base 14 to vary the leverage or moment about the foot means such as a left foot 98 and right foot 100. In turn, the internal piston shaft 198 may extend to incline the tread base 14. When the user may be positioned forwardly toward button 221, the leverage or moment is increased so that the force of extending the internal piston shaft 198 is overcome and the inclination decreased. Thus the buttons 220 and 221 are available for access and operation by a user positioned forwardly and rearwardly and in turn facilitate convenient operation. Indeed the spacing 223 may be selected so that the user must be positioned forwardly on the tread base 14 to operate the forward button 221 and rearwardly to operate the rearward button 220. In other words the buttons 220 and 221 are positioned so the user must position his or her weight forwardly to lower and rearwardly to raise the inclination.

It may be noted that an electric-powered elevation system may be used. That is, a motor may drive a reduction gear to, in turn, rotate a pinion on a rack. The rack may be connected to the base extension 130 and the motor to bracket 182. Upon activation, the pinion moves the rack and, in turn, changes the inclination. Other devices that employ springs or hydraulics also may be used to vary the inclinations.

Figure 13:
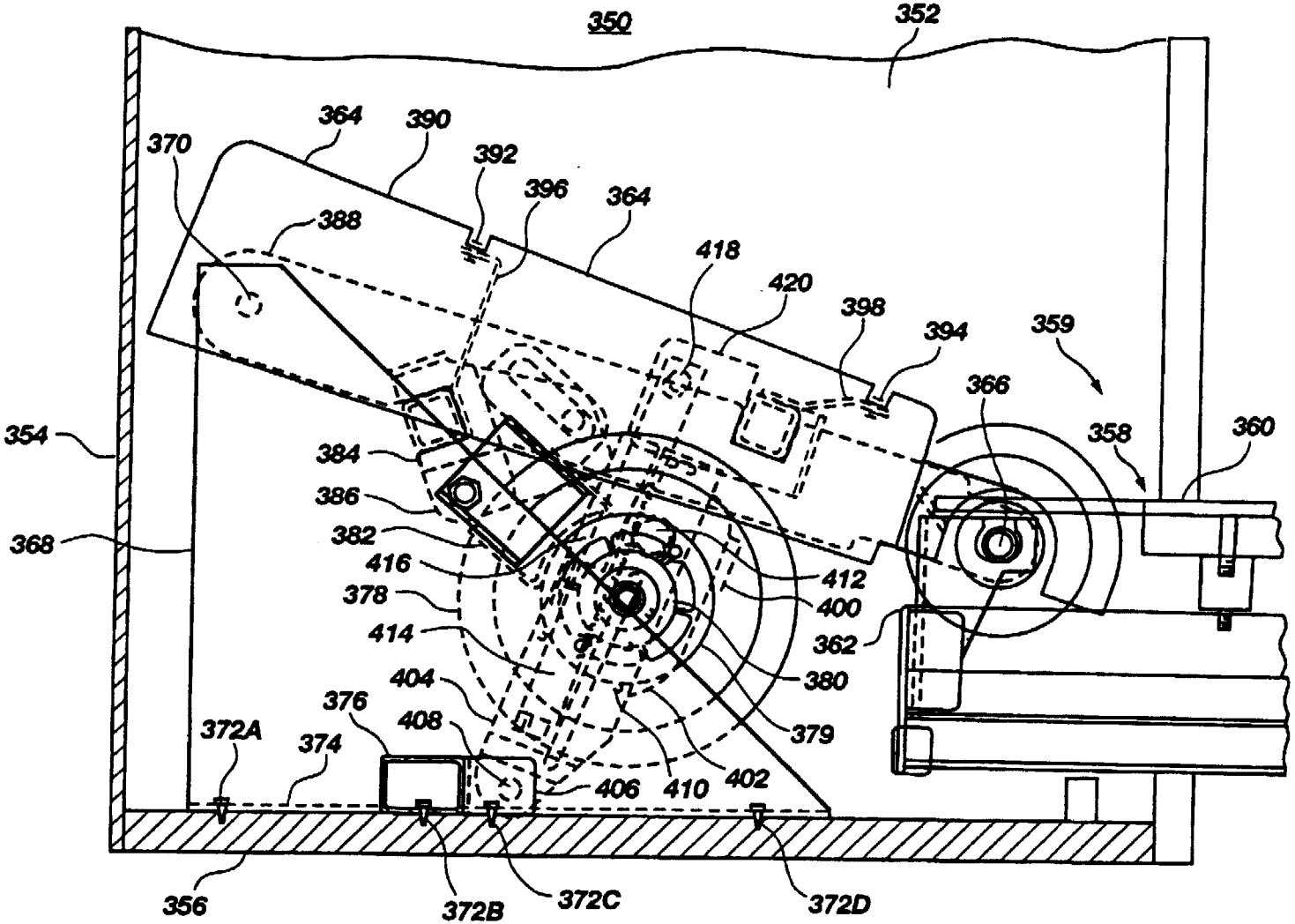
FIG. 13 is a partial cross-sectional representation of an alternate treadmill having the tread base in a first inclination position and with electrically operable elevation structure.
Figure 14:
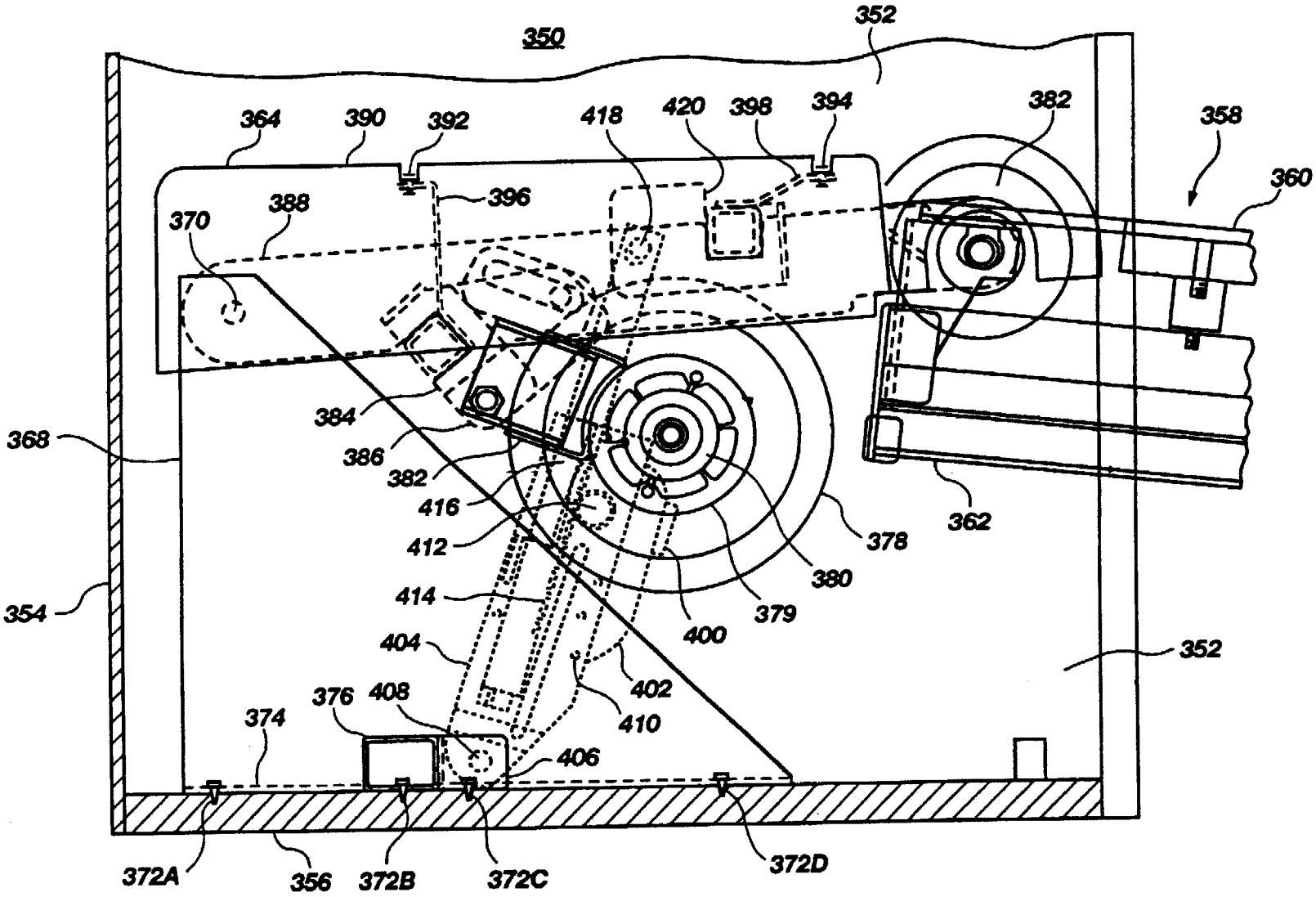
FIG. 14 is a partial cross-sectional representation of the treadmill of FIG. 13 having the tread base in a second inclination position.

FIGS. 13 and 14 illustrate a rack and pinion elevation system. Each is a partial cross-sectional view showing an enclosure structure 350 that has a right side 352, a rear 354 and a bottom 356. A tread base 358 comparable to tread base 14 is shown in a first position 359 in which a user may stand on the tread surface 360. The tread base 358 may be rotated into the enclosure structure 350 to a second or stored position comparable to the second position of the tread base 14.

The tread base 358 is shown in FIG. 13 in a first incline position in which the tread 360 is at a preselected angle or inclination relative to the support surface. FIG. 14 shows the tread base 358 in a second incline position in which the front end 362 is elevated or higher (relative to a support surface) than when in the first position.

The front end 362 is connected to base extension 364 to rotate about bolts 366 which are comparable to bolts 144 and 146. The base extension 364 itself is secured to and between spaced apart opposite upright supports 368 by pin 370. The upright support 368 is secured to bottom 356 by a plurality of screws 372A–D extending through a flange portion 374 of the upright support 368. A cross member 376 extends between the opposite upright supports 368.

A motor 379 with an inertia wheel 378 has a pulley 380 to power a drive belt (not shown) to in turn drive a pulley 382 at the front end of the tread base 358 in a manner comparable to that shown in FIGS. 3 and 4. The motor 379 is connected by brackets 382, 384 and 386 comparable to that shown in FIG. 8. The base extension 364 is shown with a subframe 388 and a cover 390 held in place by bolts 392 and 394 connected to supporting connection brackets 396 and 398.

The electrically powered elevation structure shown in FIGS. 13 and 14 has a motor 400 interconnected through a reduction gear 402. A flat strap 404 is connected by a bracket 406 to the cross member 376 by a bolt 408 or pin. The reduction gear 402 is attached to the strap 404 by appropriate screws 410. A pinion 412 is driven by the motor 400 through the reduction gear 402 to in turn drive a rack 414. A rack 414 is held in place by a retainer 416 and is rotatably connected by pin or bolt 418 to bracket 420. The bracket 420 is connected to the base extension 364.

In operation, the user actuates the motor 400 with a switch on a control console such as switch 410 which functions as operations means for operating the elevation structure. Power is thereupon supplied via conductors (not shown) to cause the motor to rotate clockwise or counterclockwise as selected to in turn cause the pinion 412 to rotate on the rack 414 and urge the base extension 364 to rotate about pin 370. The front end 362 of the tread base 358 therefore may be changed in elevation as desired by a user.

Figure 8:
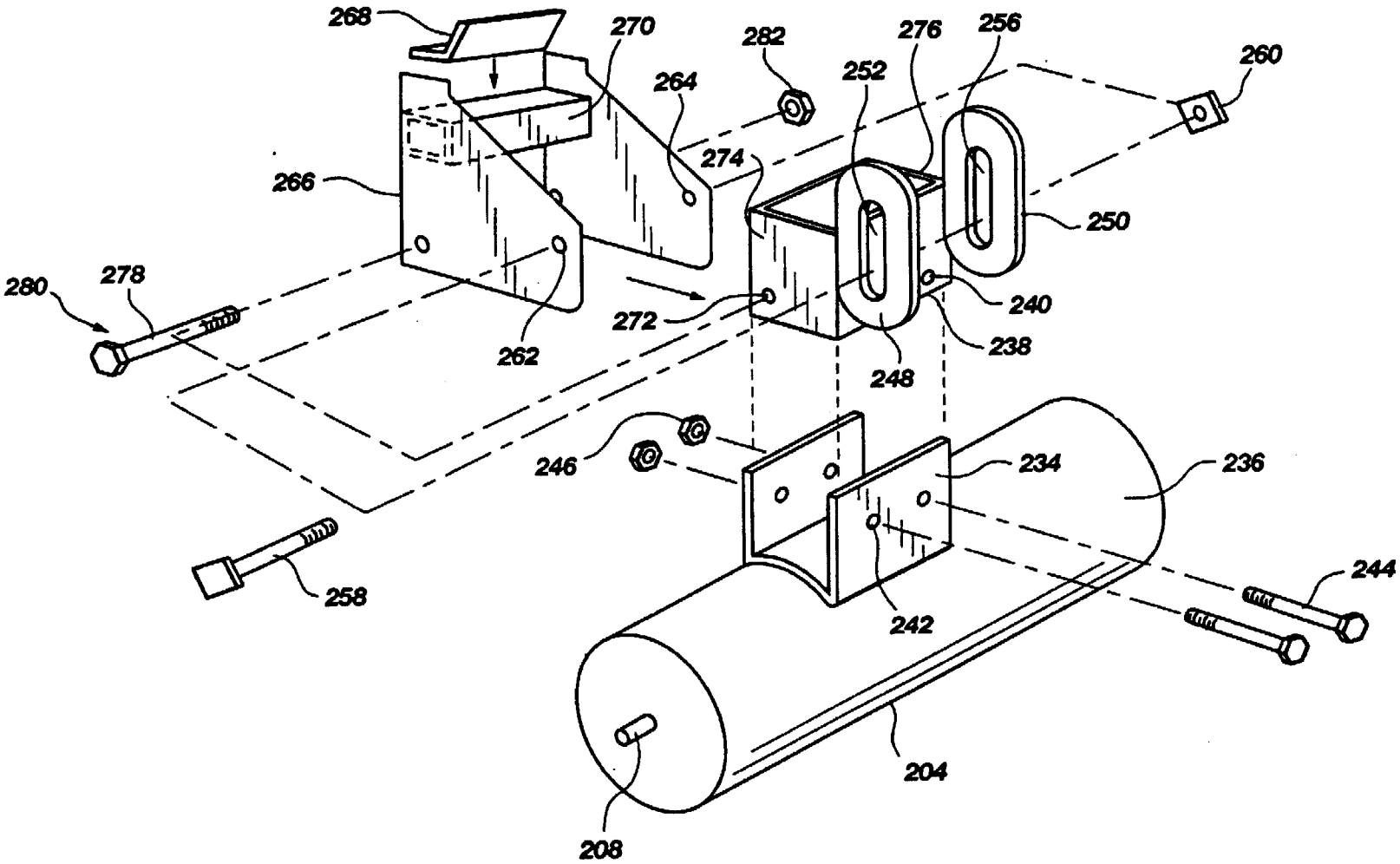
FIG. 8 is an exploded view of the motor of FIG. 1 and associated bracket structure shown in FIGS. 3 and 4.

As hereinbefore stated, FIGS. 3 and 4 also show structure to support the motor means 36 as better seen in FIG. 8. That is, the motor 204 has a connecting bracket 234 connected to the exterior surface 236 of the motor 204 by welding or by any other acceptable means to provide a rigid connection thereinbetween. A box bracket 238 is sized to fit within the motor bracket 234. The box bracket 238 has apertures such as apertures 240 sized to correlate to register with apertures such as aperture 242 in bracket 234 for interconnection to the motor bracket 234 by appropriate means such as bolts 244 with associated nuts 246. The box bracket 238 has a pair of ears 248 and 250, as shown, each having a slot 252 and 256 sized to receive the shaft of a bolt 258 shown in exploded relationship to interconnect with corresponding nut 260. The bolt 258 as well as the slots 252 and 256 are positioned to register with corresponding apertures 262 and 264 associated and formed in the base bracket 266 which is fixedly secured such as by welding to an attachment bracket 268. The attachment bracket 268 is secured to the cross support 270 by welding or other means and also to the base extension 130.

The box bracket 238 has a first aperture 272 formed in a left sidewall 274 and a corresponding aperture not shown for purposes of clarity in the right sidewall 276. The aperture 272 and its corresponding right aperture receive the shaft 278 of bolt 280 to rotatably secure therein with a nut 282 the box bracket 238 to the base bracket 266. The bolt 258 passes through the slots 252 and 256 and may be operated to adjust the tension on the belt 204B to in turn provide an arrangement whereby the belt 204B maintains constant and substantially non-changing tension as the tread base 14 is moved between the first orientation 38 and the second orientation 40 by operation of the inclination structure 34 as hereinbefore discussed. In other words, the motor bracket 234 rotates between a first position shown in FIG. 3 and a second position shown in FIG. 4 as the tread base 14 moves between the first orientation 38 and the second orientation 40.

In reference to FIG. 6, it may be noted that the front roller 154 operates about an axle 155 which in turn provides for rotation of the front roller 154 around axis 157. Axis 157 is the axis of bolts 146 and 144 and the axis of rotation for fingers 140 and 142. It may be also noted that the base extension 130 has a housing 284 unitarily formed with its upper surface 286 to cover the exposed portion of the driven pulley 202 connected to the front roller 154.

Referring back to FIG. 3, as hereinbefore stated, the tread base 14 may be oriented to a second or upright position 32 as shown in FIG. 3. The tread base 14 has a center of gravity 288 which is positioned to facilitate lifting the tread base from the first position 30 and moving it towards the second position 32. That is, the center of gravity 288 is located toward the center of rotation which is axis 157. With the center of gravity 288 located directly vertically above the axis of rotation 157, the tread base 14 will remain orientated in the second or stored position 32. The center of gravity 288 may also be oriented counterclockwise relative to the axis of rotation 157 to further enhance the retention of the tread base 14 in the second position by virtue of the lever arm developed between displacement of the center of gravity relative to the plane 290 extending vertically upward from the axis 157. Preferably the center of gravity is located between the front 92 and the middle 289 (FIG. 1).

In some configurations, the center of gravity 288 may be positioned clockwise relative to the plane 290 with the tread base 14 secured in the second or stored position 32 by a latch or other comparable structure.

As seen in FIG. 10, a latching arrangement is provided to latch the tread base 14 to the freestanding housing 12 with the tread base in the second or stored position. The latching means preferably includes a latching member which may be connected either to the tread base 14 or to the enclosure structure 18. In the configuration illustrated, the latching member is a cylindrical bar 300 attached to the left side 24 of the tread base to extend outwardly therefrom for interaction and connection to the lever member 302. The lever member 302 is rotatably attached by bracket 326 to rotate about axle 304 secured to the top 70 by a bracket 306. The lever member 302 as hereinbefore stated may be secured either to the tread base 14 or to the enclosure structure 18.

In the arrangement of FIG. 10, the lever member 302 has a first end 308 configured for operation by the user to urge the lever member 302 from its first position as shown in FIG. 10 in solid to a second position 302' shown by dashed lines. The lever member 302 has a second end 310 opposite the first end 308. The second end 310 is configured to operatively interact with the latching member 300. The latching member operates to urge the lever member 302 from the first position to the second position.

The lever member 302 has a receiving portion which is positioned to receive the latching member 300 therewithin and to hold the latching member 300 with the lever member 302 in the first position. The lever member 302 preferably has a cam surface 314 against which the latching member 300 operates as the tread base is urged towards its second position. The receiving portion 312 of the lever member 302 is preferably positioned proximate and immediately adjacent the cam surface 314 so that the latching member leaves the cam surface 314 and enters the receiving portion 312 as the tread base 14 is urged into its second position. That is, the latching member 300 is moved 301 to contact the cam surface 314 and to force the cam surface 314 and the lever member 302 to rotate about axle 304 from the first position 302 to the second position 302'.

The latching means here illustrated includes spring means to urge the lever member 302 toward the first position 302 from the second position 302'. As here illustrated, the spring means is a coil spring 316 positioned between the bracket 306 and the lever member 302. The spring 316 is configured to compress upon movement of the lever member 302 from the first position 302 to the second position 302' and in turn urge the lever member 302 clockwise against the bumper or spacer 318.

As here shown, the top 70 preferably has an aperture 320 formed therein so the user may access the lever member 302 for operation. In FIG. 10, a button 322 extends from the lever member 302 upward into the aperture 320 so that the user may operate the button 322 by use of a finger. In this way, the user may press downwardly 324 on the button 322 to cause the lever member 302 to rotate 313 about the axis 304 via its related bracket 326 and the related wear washer 328. In urging the lever arm 302 downward, the receiving portion 314 is displaced away from the latching member 300, thereby allowing the latching member 300 to be rotated away from or outwardly from the enclosure structure 18 so that the tread base 14 may in turn be rotated from the second position 32 to the first position 30. It may be understood that other latching configurations may be used as desired including a pin or bolt positioned to extend through the left side 20 into the side 24 of the tread base 14. Alternate latching arrangements may include a ball-detent, a magnetic catch and other devices to inhibit relative movement as between a door and a frame.

Figure 11:
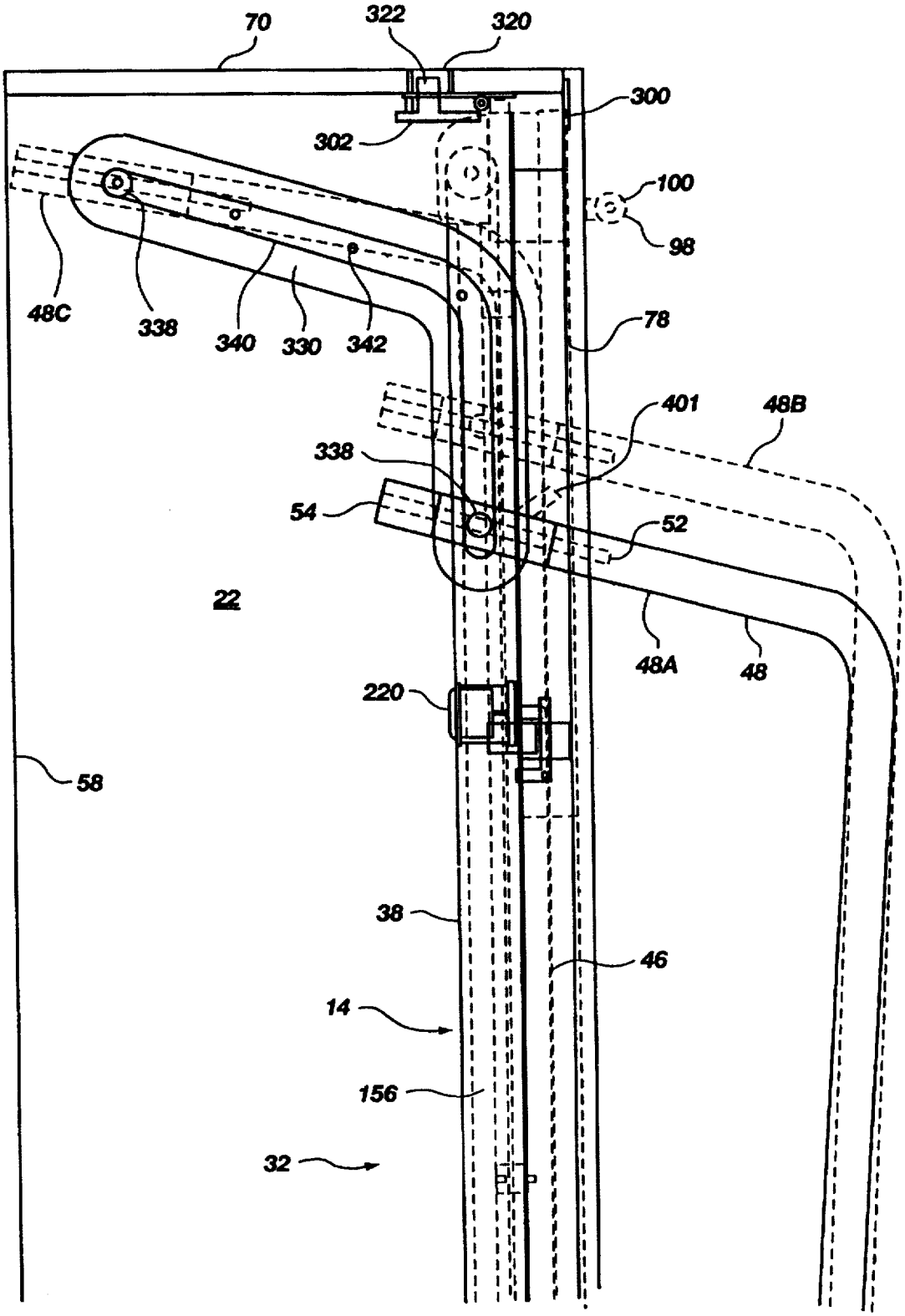
FIG. 11 is an enlarged side view of the upper portion of the treadmill of FIG. 1.
Figure 12:
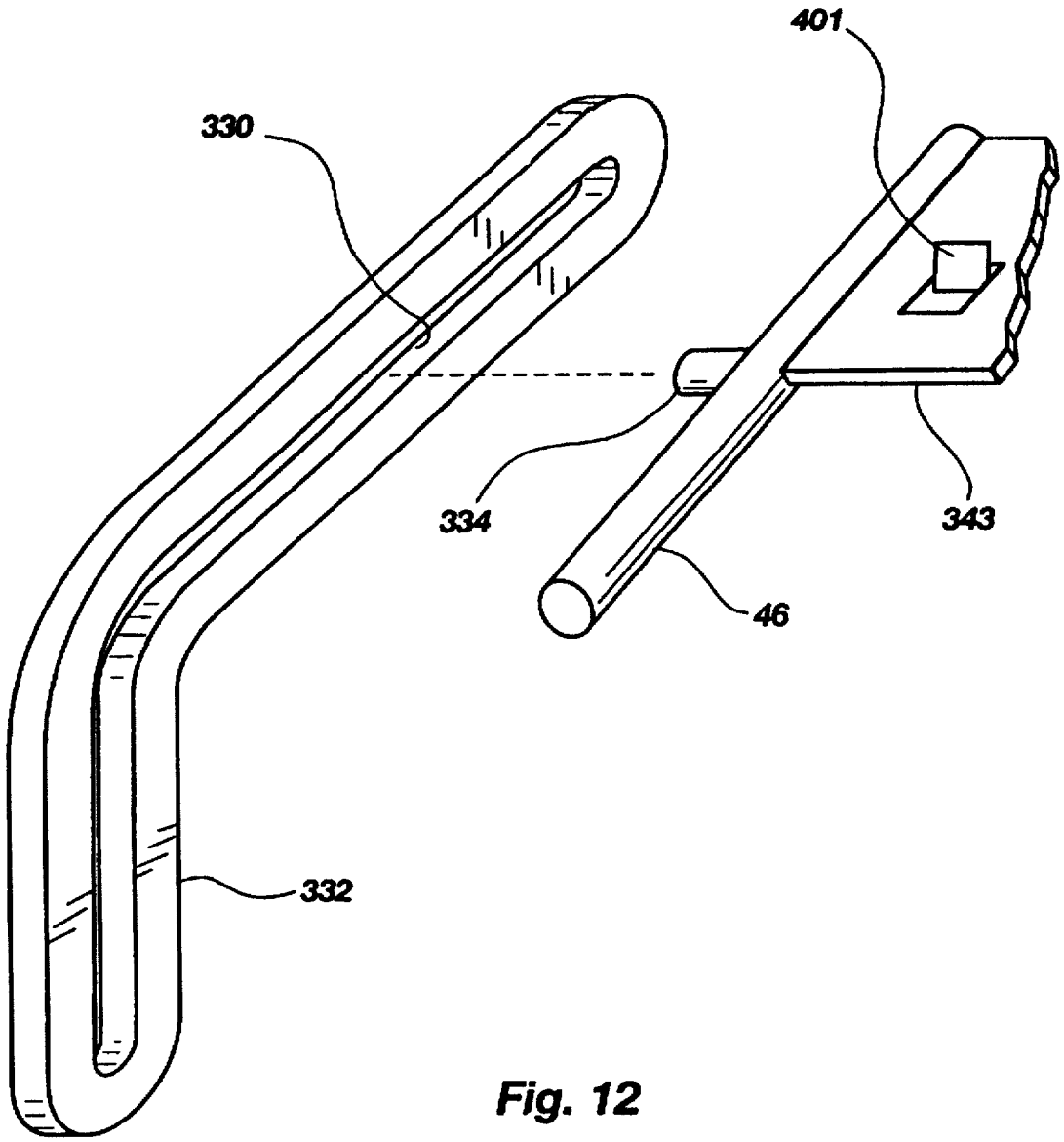
FIG. 12 is a simplified, exploded view of portions of the treadmill of FIG. 11.

Referring now to FIG. 11, the upper portion of the enclosure structure 18 is shown. The right handle 48 and the left handle 46 are positioned with their upper end 54 attached to the respective left side 20 and right side 22. As shown in FIG. 11, a right race 330 is shown attached to the right side 22 of the enclosure structure 18. The left race 332 is shown in FIG. 12 with the left handle 46 shown in part. A shaft 334 sized to snugly and slidably fit within slot 336 of the race 332 is attached to the left handle 46. The left handle 46 is shown with console 343 in place.

The upper portion of the right handle 48 includes the slot 52 which is sized to receive nuts or bolts therethrough for further connection to an electronic console 50 as better seen in FIG. 1.

The right handle 48 has a shaft 338 which is similar to shaft 334. Shaft 338 as shown is sized to be snugly slidable within the slot 340 of the right race 330.

As best seen in FIG. 11, the right handle 48 is movable between the first position 48A shown in solid in FIG. 11 which correlates to the first orientation 38 shown in FIG. 1. The handle 48 is movable from the first position 48A to a second 48B which correlates to the position of the handle 48 when the tread base 14 has been oriented to the second orientation 40.

The handle 48 may also be reoriented to the position 48C shown in phantom in FIG. 11 when the tread base 14 is reoriented to the second or storage position 32. That is, as the tread base 14 is rotated upwardly, a force is exerted via the handle 48 on the shafts 338 and 334 to cause them to move in their respective slots 340 and 336 to, in turn, guide the handles 48 and 46 inwardly into the enclosure structure 18 and into a storage position 48C as best seen in FIG. 11. The races 330 and 332 may be held in place against their respective sides 22 and 20 by a plurality of screws or bolts 342. It may be noted that the arrangement of FIG. 11 is configured with the cover 78 positioned within the enclosure as opposed to coextensive with the forward surfaces such as forward surface 80.

Figure 17:
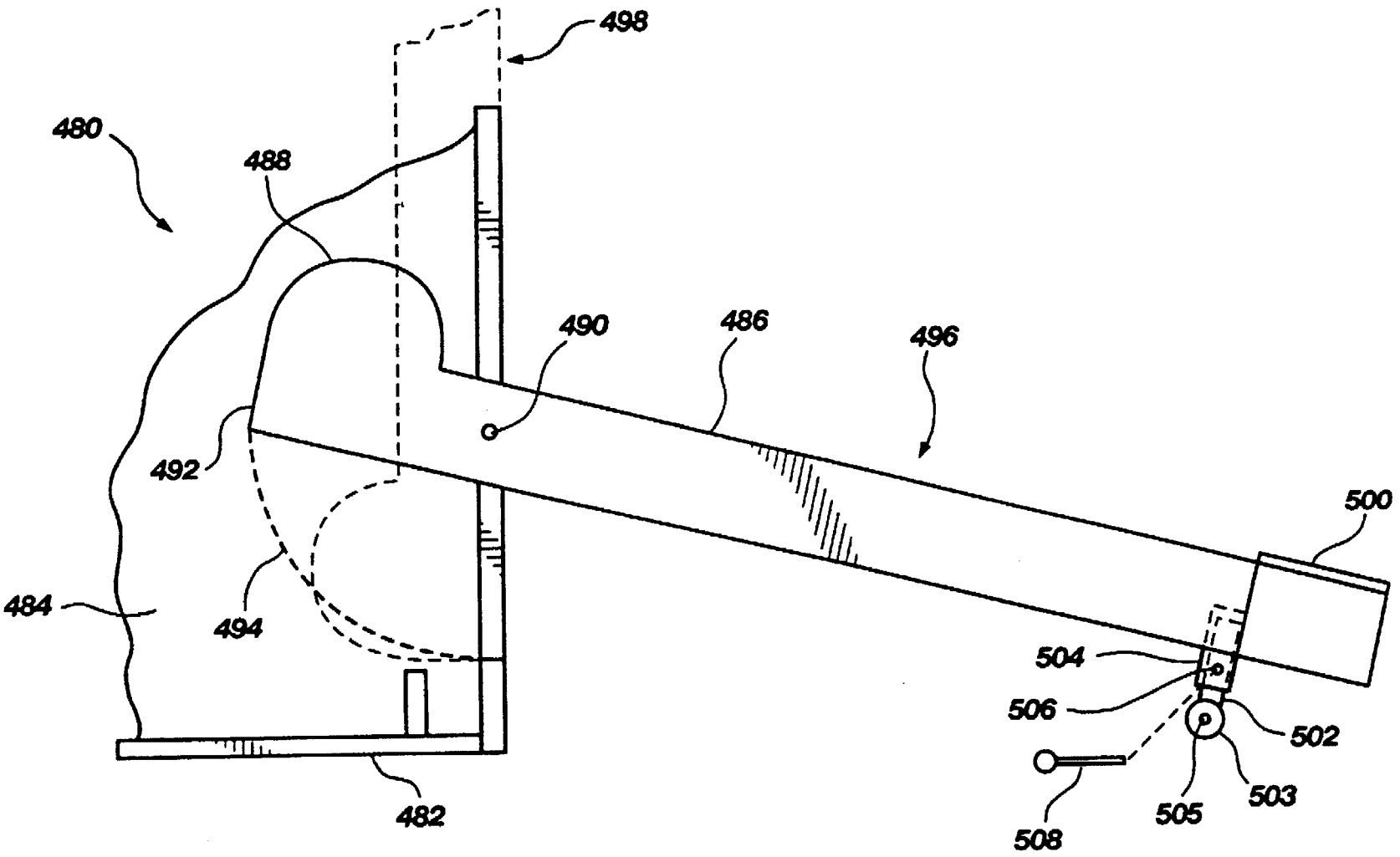
FIG. 17 is a partial, simplified side view of an alternate cabinet treadmill with alternate inclination structure.

Turning to FIG. 17, a cabinet treadmill has an enclosure structure 480 having a base 482 and opposite sides including right side 484. A tread base 486 having an endless belt (not shown) and an inertia wheel within the housing 488 is rotatably mounted to the enclosure structure to rotate about bolts such as bolt 490. The front edge 492 moves in an arc 494 as the tread base 486 is rotatable between a first position 496 in which the tread base 486 is oriented downwardly from the enclosure structure 480 for use by a user and a second or stored position 498 in which the tread base 486 is positioned upwardly within the enclosure structure 18. That is, the top 70 and sides 20 and 22 together have edges that define a perimeter towards which the cover 78 or door are proximately positioned.

The treadmill of FIG. 17 has rear feet means which support the rear 500 of the tread base 14 on a support surface with the tread base in its first position 496. The rear feet means include a pair of spaced apart opposite legs including right leg 502. The right leg 502 is sized to slidably and snugly move within leg housing 504. The leg 502 has a plurality of apertures formed in it along its length to register with a corresponding aperture 506 formed in the leg housing 504. A pin 508 is inserted into the aperture 506 and through a selected corresponding aperture in the leg 502 to vary the inclination of the tread base 486 relative to the support surface. A wheel 503 is rotatably secured by axle pin 505 to the leg 502.

Figure 18:
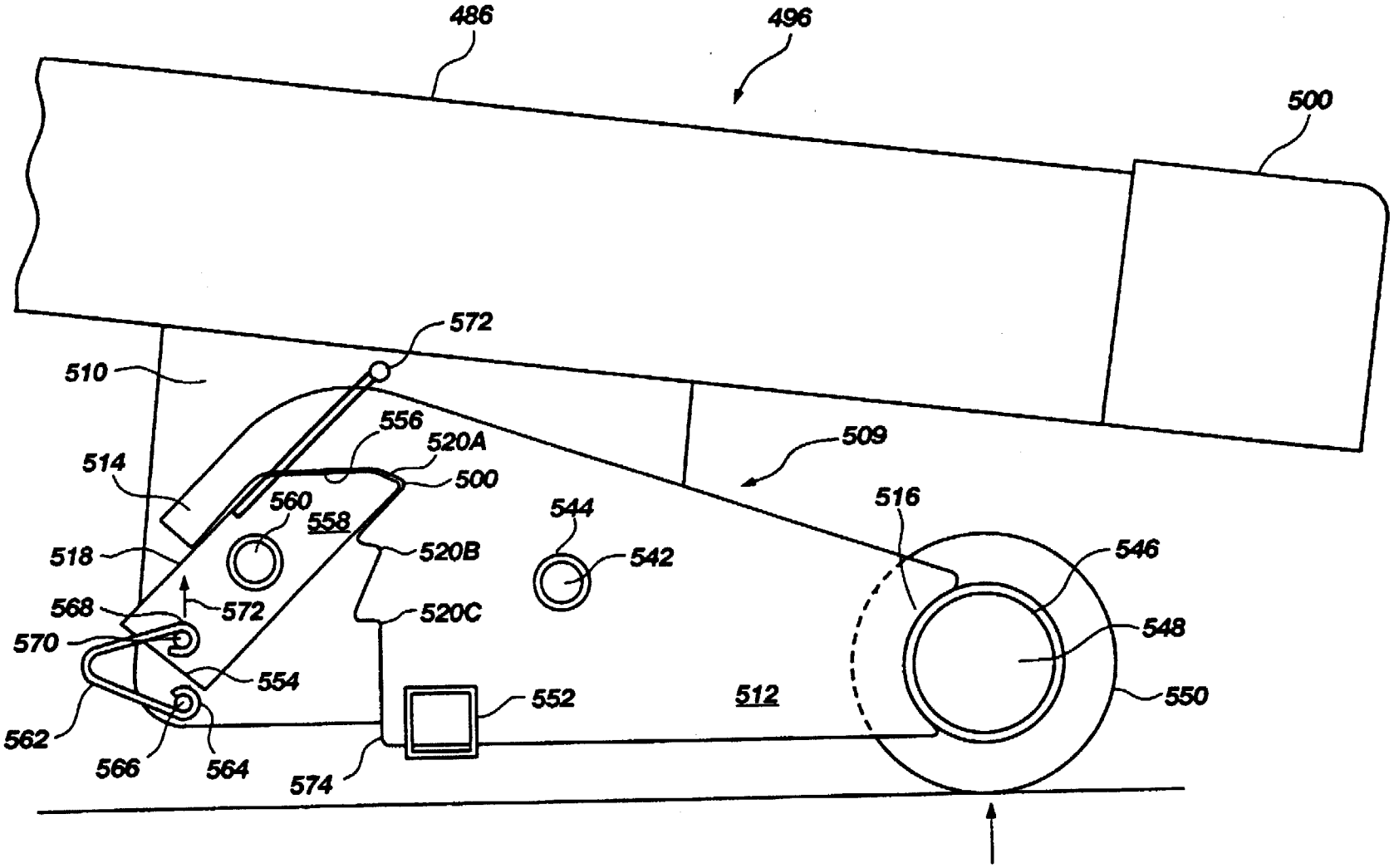
FIG. 18 is a partial, simplified side view of the alternate cabinet treadmill of FIG. 17 with another alternate inclination structure.
Figure 19:
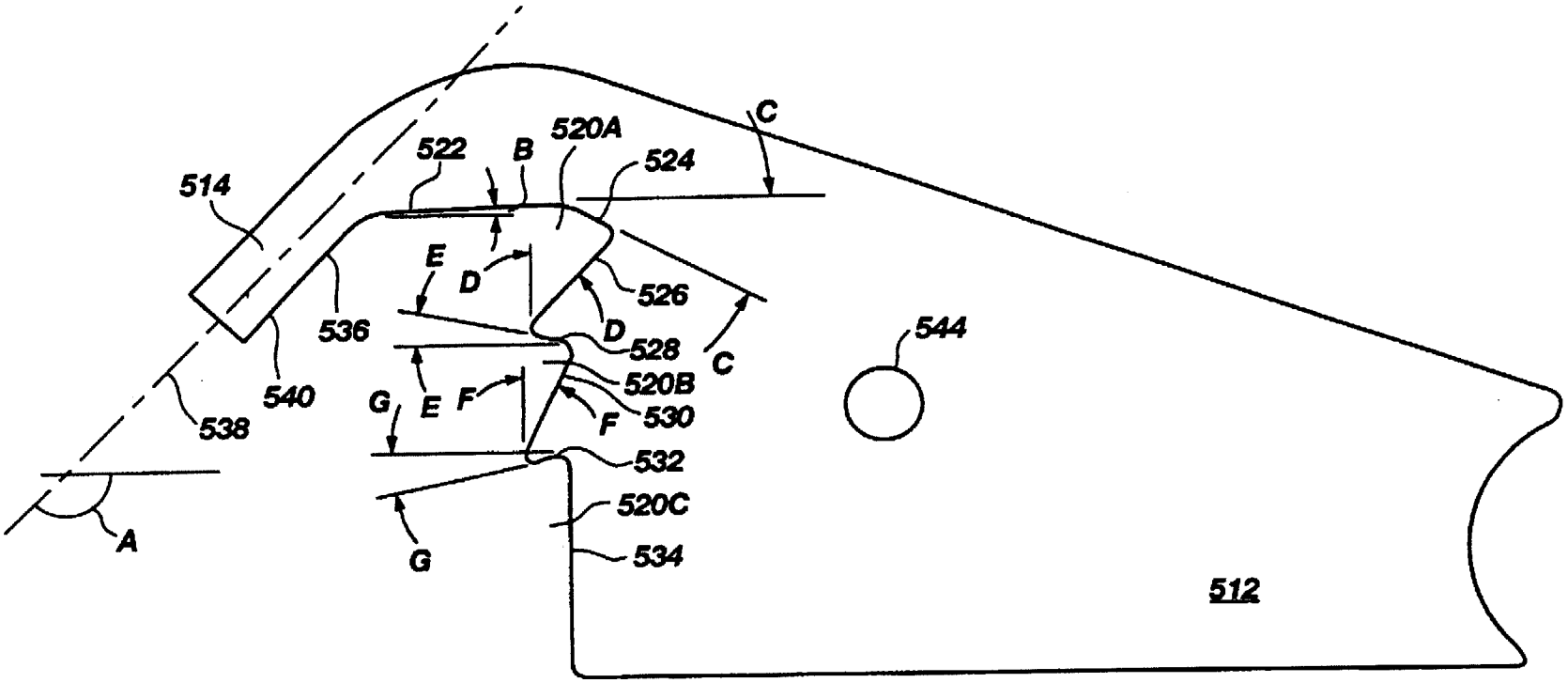
FIG. 19 is a side view of portions of the alternate inclination structure of FIG. 18.

FIG. 18 shows the treadmill of FIG. 17 with yet another alternative structure to vary the inclination of the tread base 486 when in its first position 496. A pair of spaced apart support legs proximate sides of the tread base support the tread base on a support surface. One such leg 509 is shown in FIG. 18. The other is comparable.

The leg 509 shown in FIG. 18 has a generally rectangular planar member 510 which is secured to the tread base 486 in a generally upright vertical orientation. The planar member 510 may be fabricated of metal and secured to the metal frame of the treadmill by bolts, welding or the like.

The leg 509 has a support 512 that is an elongate planar panel having a first end 514 and a second end 516. The first end 514 is shaped to be an elongate finger-like extension which functions as a stop for the pawl 518. The support 512 further has a ratchet section having a plurality of recesses or notches 520 along its perimeter. In the support 512 illustrated in FIG. 18, three distinct notches 520A, 520B and 520C are formed in the perimeter. The first notch 520A is formed by the sides 522, 524 and 526 of the support 512. The first notch 520A substantially corresponds to the perimeter of a section of the pawl 518 whereby the pawl may be surrounded on a plurality of its sides when that pawl is inserted into the first notch 520A.

The second notch 520B is defined by the sides 528 and 530 of the perimeter of the support 512. The third notch 520C is defined by the sides 532 and 534 of the support 512. The extension 536 may be viewed as being substantially a rectangularly configured section having a longitudinal axis 538 which is oriented to a horizontal axis at an angle A. Given the essentially rectangular configuration of extension 536 it should be understood that linear side 540 would also be oriented at an angle A to the horizontal. In a preferred construction, angle A may be within the range of 125 to 136 degrees and preferably 131 degrees.

The side 522 which extends from side 540 is oriented at an angle B from the horizontal. In preferred constructions angle B may be within the range of zero to ten degrees, preferably four degrees. Side 524, which extends from side 522 is oriented at an angle C from the horizontal. Angle C is within the range of 22 to 34 degrees and preferably approximately 28 degrees. Side 526 which extends from side 524 is oriented at an angle D from the vertical. In preferred constructions, angle D may be within the range of 36 to 48 degrees and preferably 43 degrees.

Side 528 which extends from side 526 is oriented at an angle E from the horizontal. In a preferred construction, angle E is within the range of four to 15 degrees and preferably nine degrees. Side 530, extending from side 528, defines an angle F with the vertical. Angle F is preferably within the range of 17 to 29 degrees and preferably 23 degrees. Side 532, which extends from side 530, is oriented at an angle G from the horizontal. Angle G is within the range of five to fifteen degrees and preferably ten degrees. Side 534, which extends from side 532 is oriented vertically upright, i.e. at an angle of 90 degrees to the horizontal. Sides 526 and 530 are dimensioned to provide sufficiently deep notches to enable the top of the pawl 518 to be received in the notches 520B and 520C and form a detachable union with each notch to retain the support in a fixed orientation relative to the exercise apparatus.

The support 512 is rotatably connected to the planar member 510 by means of a pivot axle 542. The pivot axle 542 is an elongate cylindrical member which extends outwardly and perpendicularly from the surface of the planar member 510. The axle 542 extends through a circular aperture 544 formed in the support 512. The axle 542 may be fixedly secured to the planar member 510 while the support 512 is rotatable about the axle 542. Alternatively, the axle 542 may be fixedly secured to the support 512 and rotatably secured to the planar member 510. The axle 542 may also be rotatably secured to the planar member 510 while the support 512 is rotatably secured to the axle 542.

The end 516 of the support 512 may be adapted to a connection bar 546 which extends between two spaced apart supports. The opposing ends 548 of the bar 546 are fitted with end caps 550. The end caps 550 are preferably fabricated from a material having a high coefficient of friction. The end caps 550 rest directly on the underlying surface and form the point of contact between the incline adjustment mechanism and the underlying surface. The opposite supports may be further interconnected to one another by means of a spacer bar 552.

The pawl 518 is a planar member having a somewhat rectangular configuration on one end 554 thereof and an angled surface 556 on its other end 558. The pawl 518 is rotatably secured to the planar member 510 by a pivot axle 560. Axle 560 may be configured as an elongate cylindrical shaft which is either fixedly or rotatably secured to the planar member 510 so that the pawl 518 is rotatable with respect to that planar member 510.

A substantially V-shaped spring 562 is secured at its first end 564 to the planar member 510 by means of a pin 566. The end 564 is formed into a substantially circular configuration which in turn is wrapped around the pin 566. The opposing end 568 of the spring 562 is also formed into a generally circular configuration which in turn is also secured about a pin 570 which is affixed to the pawl 518. The spring 562 is constructed to exert a force in the direction of arrow 572. The spring 562 therefore urges the pawl 518 and, more specifically, the surface 556 to rotate clockwise into abutment against the support 512 proximate the notches of that support. Therefore, when the support 512 is rotated in a clockwise direction about axle 542, for example by the operation of gravity as the end 500 of the tread base 486 is lifted, the pawl 518 is urged against the perimeter of the support 512 which defines the notches. As the surface 556 of the pawl 518 is urged into one of the notches, the pawl 518 forms a detachable connection with the support 512.

When the support 512 engages an underlying surface, such as a floor, the support is urged to rotate in a counterclockwise direction about its pivot axle 542. Should the pawl 518 be secured in notch 520A of the support 512, counterclockwise rotation of support 512 is precluded by the pawl 518. When the end 500 of the treadmill is lifted vertically, the weight of the bar 546 and other components at the end 516 of the support 512 urges the support 512 to rotate clockwise about the axle 542. The spring 562 is configured such that the force applied to the pawl 518 is less than the torque or force urging clockwise rotation of the support 512.

In lieu of the spring 562, a weight 572 may be attached to the pawl 518 to urge it to rotate clockwise from notch 520A to notch 520B and 520C, but to rotate counterclockwise when the pawl 518 is urged to a more upright orientation by corner 574. The operation of the leg 509 is described more fully in U.S. patent application Ser. No. 539,249 filed Oct. 5, 1995, the disclosure of which is incorporated herein by reference.

In operation, the user positions the tread base 14 in the first position 30 for use. The user performs exercises by positioning himself or herself on the endless belt 28 to commence exercises in the form of walking, jogging or running. In the event the treadmill is configured to be electrically powered, the user operates an appropriate on/off switch and other controls conveniently located in a conventional manner as known in the art.

During the course of exercise, the user may operate the buttons 220 or 221 in order to vary the inclination and, in turn, the degree of difficulty of the exercise. The user may lift the rear end 68 of the tread base 14 upwards towards the second position 32 while operating the button 220 at an appropriate time to lower the front end 69 towards the base 16 as the tread base 14 is rotated inward and toward the second position 32 and is latched in the second position by operation of a latching means as hereinbefore discussed. Those skilled in the art will recognize that reference herein to specific embodiments is not intended to limit the scope of the claims which themselves recite those features which are regarded as essential to the invention.

What is claimed is:

1. A treadmill comprising:

a freestanding housing having surface engaging means for engaging a support surface, and enclosure structure extending upwardly from said surface engaging means;

a tread base having a left side and a right side with an endless belt positioned thereinbetween, said tread base being movably attached to said freestanding housing to be orientable between a first position in which said tread base extends away from said freestanding housing with said endless belt positioned to support a user performing exercise thereon and a second position in which said tread base is positioned into said freestanding housing; and lift means interconnected between said enclosure structure and said tread base to urge said tread base from said first position toward said second position.

2. The treadmill of claim 1, wherein said lift means is a gas cylinder which continuously urges the tread base from said first position toward said second position.

3. The treadmill of claim 2, wherein said gas cylinder is attached to one of said left side and said right side of said tread base at one end of the gas cylinder.

4. The treadmill of claim 3, wherein said enclosure structure has a left wall and a right wall and wherein the other end of said gas cylinder is attached to the respective left wall and right wall.

5. The treadmill of claim 4, wherein said tread base rotates about an axis between said first position and said second position, wherein said tread base has a rear and wherein said gas cylinder is attached to one of said left side and said right side between said axis and said rear.

6. The treadmill of claim 5, wherein the gas cylinder exerts a force selected to be less than the gravitational force of the tread base when moving between the first position and the second position.

7. The treadmill of claim 6, wherein in said second position said tread base is positioned substantially within said enclosure structure.

8. The treadmill of claim 7, wherein said tread base is rotatably connected to said freestanding housing, and wherein said enclosure structure includes a left side and a right side and wherein said tread base is substantially between said left side and said right side of said enclosure structure in said second position.

9. The treadmill of claim 8, wherein said enclosure structure has a back, a side and a top.

10. A treadmill comprising:

a freestanding housing having surface engaging means for engaging a support surface, and enclosure structure extending upwardly from said surface engaging means;

a tread base having a left side and a right side with an endless belt positioned thereinbetween, said tread base being movably attached to said freestanding housing to be orientable between a first position in which said tread base extends away from said freestanding housing with said endless belt positioned to support a user performing exercise thereon and a second position in which said tread base is positioned substantially within said enclosure structure; and lift means interconnected between said enclosure structure and said tread base to urge said tread base from said first position toward said second position.

11. A treadmill comprising:

a freestanding housing having surface engaging means for engaging a support surface, and enclosure structure extending upwardly from said surface engaging means;

a tread base having a left side and a right side with an endless belt positioned thereinbetween, said tread base having a center of gravity and said tread base being movably attached to said freestanding housing to be orientable between a first position in which said tread base extends away from said freestanding housing with said endless belt positioned to support a user performing exercise thereon and a second position in which said tread base is positioned toward said freestanding housing with said center of gravity positioned to retain said tread base in said second position; and lift means interconnected between said enclosure structure and said tread base to urge said tread base from said first position toward said second position.

12. A treadmill comprising:

a freestanding housing having surface engaging means for engaging a support surface, and enclosure structure extending upwardly from said surface engaging means;

a tread base having a front, a left side and a right side with an endless belt positioned between said left side and said right side, said tread base having a mass with a center of gravity and said tread base being movably attached to said freestanding housing to be orientable between a first position in which said tread base extends away from said freestanding housing with said endless belt positioned to support a user performing exercise thereon and a second position in which said tread base is positioned toward said freestanding housing with said center of gravity positioned relative to said front in said second position to resist movement of said tread base from said second position; and lift means interconnected between said enclosure structure and said tread base to urge said tread base from said first position toward said second position.

13. A treadmill comprising:

a freestanding housing having surface engaging means for engaging a support surface, and enclosure structure extending upwardly from said surface engaging means;

a tread base having a front, a middle, a left side and a right side with an endless belt positioned between said left side and said right side, said tread base having a mass with a center of gravity and said tread base being movably attached to said freestanding housing to be orientable between a first position in which said tread base extends away from said freestanding housing with said endless belt positioned to support a user performing exercise thereon and a second position in which said tread base is positioned toward said freestanding housing with said center of gravity between said front and said middle; and lift means interconnected between said enclosure structure and said tread base to urge said tread base from said first position toward said second position.

14. A treadmill comprising:

a freestanding housing having surface engaging means for engaging a support surface, and enclosure structure extending upwardly from said surface engaging means, said enclosure structure having a left wall and a right wall spaced from said left wall;

a tread base having a rear, a left side and a right side with an endless belt positioned between said left side and said right side, said tread base being movably attached to said freestanding housing to be orientable about an axis of rotation between a first position in which said tread base extends away from said freestanding housing with said endless belt positioned to support a user performing exercise thereon and a second position in which said tread base is positioned toward said enclosure structure; and a gas cylinder having one end connected to one of said left wall and said right wall of said enclosure structure and having the other end connected to the corresponding one of said left side and said right side of said tread base between said rear and said axis of rotation, said gas cylinder continuously urging said tread base from said first position toward said second position, said gas cylinder exerting a lifting force selected to reduce the force urging the tread base toward the first position when the tread base is moving between the first position and the second position.

* * * * *

UNITED STATES PATENT AND TRADEMARK OFFICE

CERTIFICATE OF CORRECTION

PATENT NO. : 5,718,657

DATED : February 17, 1998

INVENTOR(S) : Dalebout, William T.; Watterson, Scott R.; Miller, Frank Troy

It is certified that error appears in the above-identified patent and that said Letters Patent is hereby corrected as shown below:

In column 5, line 30, change "rarely" to --firmly--;
In column 6, line 1, after "specifically" add --,--;
In column 6, line 13, after "back" insert --wall--;
In column 6, line 39, change "19" to --18--;
In column 6, line 47, after "back" insert --wall--;
In column 6, line 66, after "back" insert --wall--;
In column 7, line 62, change "154" to --155--;
In column 10, line 36, after "tread" insert --surface--;

Signed and Sealed this

Eighth Day of September, 1998

*Attest:*

Bruce Lehman

BRUCE LEHMAN

*Attesting Officer*

*Commissioner of Patents and Trademarks*